US005538835A

United States Patent [19]

Hosokawa

[11] Patent Number: 5,538,835

[45] Date of Patent: Jul. 23, 1996

[54] SILVER HALIDE COLOR PHOTOGRAPHIC MATERIAL

[75] Inventor: Junichiro Hosokawa, Kanagawa, Japan

[73] Assignee: Fuji Photo Film Co., Ltd., Kanagawa, Japan

[21] Appl. No.: 253,859

[22] Filed: Jun. 3, 1994

[30] Foreign Application Priority Data

Jun. 3, 1993 [JP] Japan ..... 5-133592
Jul. 6, 1993 [JP] Japan ..... 5-191663

[51] Int. Cl.[6] ..... G03C 1/46

[52] U.S. Cl. ..... 430/503; 430/551; 430/567

[58] Field of Search ..... 430/505, 502, 430/503, 551, 372, 567

[56] References Cited

U.S. PATENT DOCUMENTS

| | | | |
|---|---|---|---|
| 5,104,782 | 4/1992 | Seto et al. | 430/551 |
| 5,122,444 | 6/1992 | Sakai | 430/551 |
| 5,275,929 | 1/1994 | Buitano et al. | 430/567 |
| 5,294,530 | 3/1994 | Seto et al. | 430/557 |
| 5,330,888 | 7/1994 | Morigaki et al. | 430/551 |

*Primary Examiner*—Geraldine Letscher
*Attorney, Agent, or Firm*—Sughrue, Mion, Zinn, Macpeak & Seas

[57] ABSTRACT

A silver halide color photographic material comprising a support having provided thereon at least one blue-sensitive silver halide emulsion layer containing a yellow coupler, at least one green-sensitive silver halide emulsion layer containing a magenta coupler and at least one red-sensitive silver halide emulsion layer containing a cyan coupler, wherein at least one layer contains at least one compound selected from those represented by the following formula (A) and the silver halide grains to be in at least one of the silver halide emulsion layers have a mean grain size of 0.25 μm or smaller, (A)

wherein $Ra_1$ to $Ra_5$, which may be the same or different, each represents (1) a hydrogen atom, (2) an alkyl group, (3) —X—$Ra_0$, or (4) a group necessary for forming a chroman ring by two of $Ra_1$ to $Ra_5$ which are ortho-positioned and are bonded to each other; X represents —C($Ra_6$)($Ra_7$)—, —O—, or —S—; $Ra_6$ and $Ra_7$ each represents a hydrogen atom or an alkyl group; $Ra_0$ represents a hydroxyphenyl group, but it may be an alkyl group when X is —C($Ra_6$)($Ra_7$)—, both $Ra_6$ and $Ra_7$ are alkyl groups and both $Ra_1$ and $Ra_5$ are (—X—$R_0$)'s; provided that $Ra_3$ must not be a hydrogen atom, that at least one of $Ra_1$ to $Ra_5$ is the group (3) or (4) and that, when $Ra_3$ is —X—$Ra_0$ and $Ra_0$ is a hydroxyphenyl group, both $Ra_1$ and $Ra_5$ must not be hydrogen atoms.

11 Claims, No Drawings

SILVER HALIDE COLOR PHOTOGRAPHIC MATERIAL

FIELD OF THE INVENTION

The present invention relates to a silver halide color photographic material and, more precisely, to a silver halide color photographic material which contains silver halide emulsion(s) having a relatively small grain size, the photographic material therefore having excellent graininess and sharpness while the stability of the photographic properties of the photographic material with the lapse of time, after having been exposed, is improved.

BACKGROUND OF THE INVENTION

Heretofore, techniques for improving the stability of the images to be reproduced in silver halide color photographic materials and for improving the image quality of the reproduced color images (especially, the graininess and the sharpness thereof) have been desired, and various studies and developments have been made for these purposes. In particular, since the intended levels of the graininess and the sharpness of duplicating color photographic materials are high, it is necessary to plan the photographic materials by using silver halide emulsions of extremely fine grains. The use of silver halide emulsions of extremely fine grains brings about not only the improvement of the graininess of the photographic materials but also the improvement of the sharpness of them as reducing the degree of scattering of light in the photographic materials. Therefore, the use of such fine silver halide grains is extremely favorable from the viewpoint of improving the image quality of the color images to be reproduced in the photographic materials.

However, the use of silver halide emulsions of fine grains in producing color photographic materials so as to improve the image quality of the color images to be reproduced in the photographic materials has caused an additional problem. Precisely, when silver halide emulsions of fine grains having a grain size of 0.25 μm or smaller was used in preparing color photographic materials, the graininess and the sharpness of the photographic materials were surely improved, but, surprisingly, it has been found that when the photographic materials were exposed, allowed to stand and then developed, the sensitivity of the photographic materials was noticeably lowered as compared with the photographic materials that were developed immediately after their exposure. For this reason, it was indispensable to develop the technique capable of improving the keeping quality, in particular, the variation of the photographic properties of the exposed photographic materials with the lapse of time, in addition to the technique for improving the graininess and the sharpness of the photographic materials.

Regarding the improvement of the graininess and the sharpness of color photographic materials, JP-A-62-99751, JP-A-4-217242 and JP-A-4-275544 (the term "JP-A" as used herein means an "unexamined published Japanese patent application") have disclosed techniques of using silver halide grains having a relatively small grain size. Specifically, these publications mention techniques for further improving the graininess and the sharpness of photographic materials by using silver halide emulsions of fine tabular grains and also techniques for improving the gradation and the color reproducibility of photographic materials, in addition to the graininess and the sharpness thereof, by modifying the layer constitutions of photographic materials and by using diffusive DIR compounds along with such fine grains. However, these have no description relating to the technique for improving the keeping quality of the photographic materials containing fine silver halide grains, especially for overcoming the lowering of the sensitivity of the photographic materials containing silver halide emulsions of fine silver halide grains which were exposed, stored and then developed. The inventor of the present invention has found for the first time that the sensitivity of the color photographic material containing fine silver halide grains is specifically lowered if the photographic materials are stored after exposure.

Further, JP-A-60-12540 discloses a silver halide photographic material comprising Lippmann-type silver halide grains having a grain size of 0.10 μm or smaller and a bisphenol derivative. However, the technique as disclosed in JP-A-60-12540 relates to improving the keeping quality of black-and-white image after black-and-white development, which is quite different from the technique of the present invention which relates to improving the stability with the lapse of time of photographic property of the exposed color photographic material to vary before processing.

Given the situation, it is desired to attain the technique capable of further improving the storage stability of the color photographic materials containing fine silver halide grains, in addition to improving the graininess and the sharpness thereof, for the purpose of satisfying the recent users' demands that they want to have easily handlable high-quality photographic materials.

SUMMARY OF THE INVENTION

The object of the present invention is to provide a silver halide color photographic material which contains silver halide emulsions of fine grains, the photographic material therefore having excellent graininess and sharpness while the fluctuation of the photographic properties of the photographic material with the lapse of time, after having been exposed, is almost negligible.

The object of the present invention has been attained by a silver halide color photographic material comprising a support having provided thereon at least one blue-sensitive silver halide emulsion layer containing a yellow coupler, at least one green-sensitive silver halide emulsion layer containing a magenta coupler and at least one red-sensitive silver halide emulsion layer containing a cyan coupler, wherein at least one layer contains at least one compound selected from those represented by the following formula (A) and the silver halide grains to be in at least one of the silver halide emulsion layers have a mean grain size of 0.25 μm or smaller,

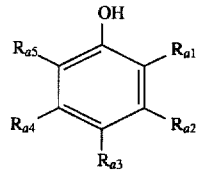

(A)

wherein $Ra_1$ to $Ra_5$, which may be the same or different, each represents (1) a hydrogen atom, (2) an alkyl group, (3) —X—$Ra_0$, or (4) a group necessary for forming a chroman ring by two of $Ra_1$ to $Ra_5$ which are ortho-positioned and are bonded to each other; X represents —C($Ra_6$)($Ra_7$)—, —O—, or —S—; $Ra_6$ and $Ra_7$ each represents a hydrogen atom or an alkyl group; $Ra_0$ represents a hydroxyphenyl group, but it may be an alkyl group when X is —C($Ra_6$)($Ra_7$)—, both $Ra_6$ and $Ra_7$ are alkyl groups and both $Ra_1$ and $Ra_5$ are (—X—$Ra_0$)'s; provided that $Ra_3$ must not be a hydrogen atom, that at least one of $Ra_1$ to $Ra_5$ is the group (3) or (4) and that, when $Ra_3$ is —X—$Ra_0$ and $Ra_0$ is a hydroxyphenyl group, both $Ra_1$ and $Ra_5$ must not be hydrogen atoms.

DETAILED DESCRIPTION OF THE INVENTION

Next, the present invention will be explained in more detail hereunder.

First, the compounds represented by the following formula (A) will be explained concretely and in detail.

(A)

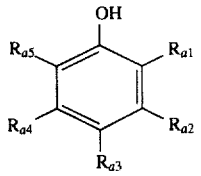

wherein $Ra_1$ to $Ra_5$, which may be the same or different, each represents (1) a hydrogen atom, (2) an alkyl group, (3) —X—$Ra_0$, or (4) a group necessary for forming a chroman ring by two of $Ra_1$ to $Ra_5$ which are ortho-positioned and are bonded to each other; X represents —C($Ra_6$)($Ra_7$)—, —O—, or —S—; $Ra_6$ and $Ra_7$ each represents a hydrogen atom or an alkyl group; $Ra_0$ represents a hydroxyphenyl group, but it may be an alkyl group when X is —C($Ra_6$)($Ra_7$)—, both $Ra_6$ and $Ra_7$ are alkyl groups and both $Ra_1$ and $Ra_5$ are (—X—$Ra_0$)'s; provided that $Ra_3$ must not be a hydrogen atom, that at least one of $Ra_1$ to $Ra_5$ is the group (3) or (4) and that, when $Ra_3$ is —X—$Ra_0$ and $Ra_0$ is a hydroxyphenyl group, both $Ra_1$ and $Ra_5$ must not be hydrogen atoms.

The substituents as referred to herein may have additional substituent(s).

In the formula (A), $Ra_1$ to $Ra_5$, which may be the same or different, each represents (1) a hydrogen atom, (2) an alkyl group (preferably having from 1 to 30 carbon atoms, such as methyl, t-butyl, t-octyl, cyclohexyl, 2'-hydroxybenzyl, 4'-hydroxybenzyl), (3) —X—$Ra_0$, or (4) a group necessary for forming a chroman ring by two of $Ra_1$ to $Ra_5$ which are ortho-positioned and are bonded to each other.

X represents —C($Ra_6$)($Ra_7$)—, —O—, or —S—. $Ra_6$ and $Ra_7$ each represents a hydrogen atom or an alkyl group (preferably having from 1 to 26 carbon atoms, such as methyl, ethyl, propyl, isopropyl, octyl, cyclohexyl, benzyl, hexadecyl, methoxyethyl). $Ra_0$ represents an alkyl group (preferably having from 1 to 26 carbon atoms, such as methyl, ethyl, propyl, isopropyl, octyl, cyclohexyl, benzyl, hexadecyl, methoxyethyl) when X is —C($Ra_6$)($Ra_7$)—, both $Ra_6$ and $Ra_7$ are alkyl groups and both $Ra_1$ and $Ra_5$ are (—X—$Ra_0$)'s; and in the other cases, $Ra_0$ is a hydroxyphenyl group (e.g., unsubstituted hydroxyphenyl or substituted hydroxyphenyl preferably having from 6 to 30 carbon atoms, such as o-hydroxyphenyl, m-hydroxyphenyl, p-hydroxyphenyl, 3-t-butyl-2-hydroxy-5-methylphenyl, 3,5-di-t-butyl-4-hydroxyphenyl). When $Ra_0$ is an alkyl group, both $Ra_5$ and $Ra_3$ are preferably alkyl groups.

In the formula (A), $Ra_3$ must not be a hydrogen atom, and at least one of $Ra_1$ to $Ra_5$ is the group (3) or (4). The compounds represented by the formula (A) where at least one of $Ra_1$ to $Ra_5$ is the group (3) are preferably bisphenols or trisphenols, more preferably bisphenols.

Of the compounds represented by the formula (A), especially preferred are those represented by the following formula (A-I) or (A-II) in view of the effect of the present invention. Most preferred are those represented by the formula (A-II).

(A-I)

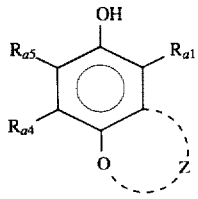

(A-II)

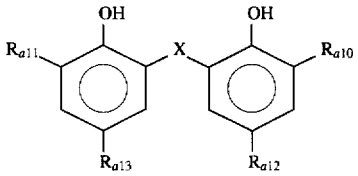

In the formula (A-I), $Ra_1$, $Ra_4$ and $Ra_5$ have the same meanings as those defined in the formula (A). Z represents an atomic group necessary for forming a chroman ring. Of the compounds represented by the formula (A-I), preferred are those where $Ra_5$ is an alkyl group in view of the effect of the present invention.

In the formula (A-II), X has the same meaning as that defined in the formula (A). $Ra_{10}$ to $Ra_{13}$ each represents an alkyl group. Of the compounds represented by the formula (A-II), preferred are those where X is —CH($Ra_6$)— in which $Ra_6$ is especially preferably a hydrogen atom or an alkyl group having from 1 to 11 carbon atoms.

Specific examples of the compounds represented by the formula (A) usable in the present invention are mentioned below, which, however, are not limitative.

(A-1)

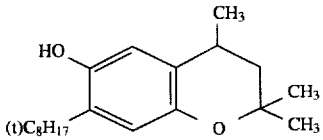

(A-2)

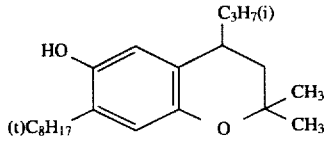

(A-3)

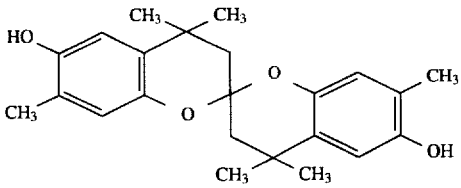

(A-4)

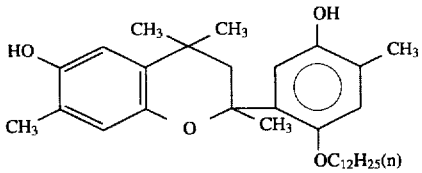

-continued
(A-5)
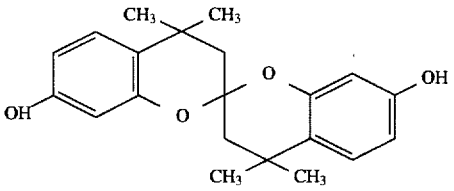
(A-6)
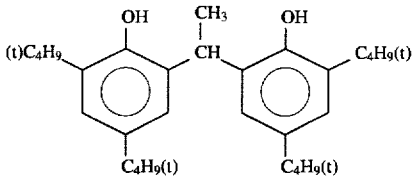
(A-7)
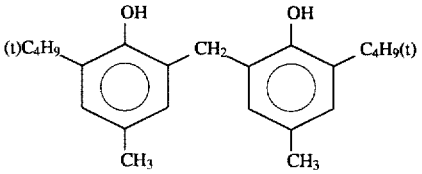
(A-8)
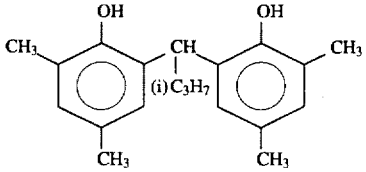
(A-9)
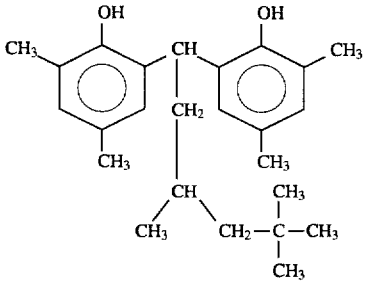
(A-10)
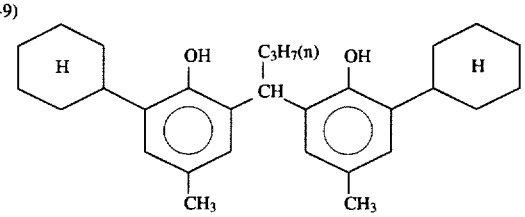
(A-11)
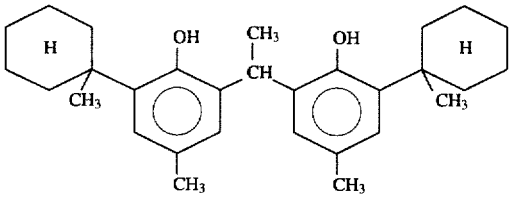
(A-12)
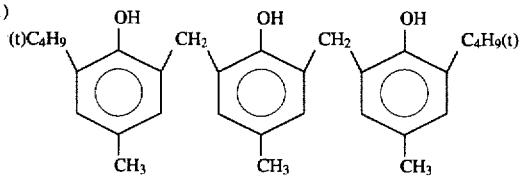
(A-13)
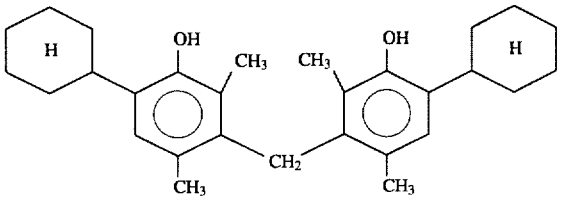
(A-14)
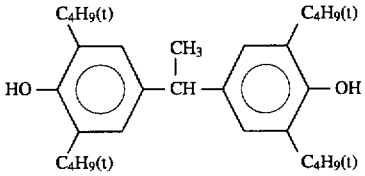
(A-15)
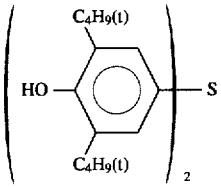
(A-16)
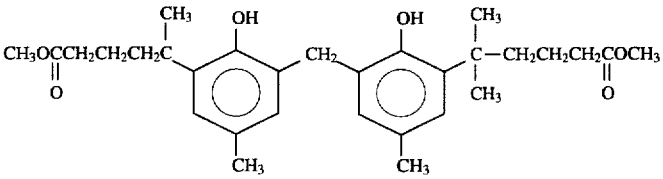

-continued
(A-17)
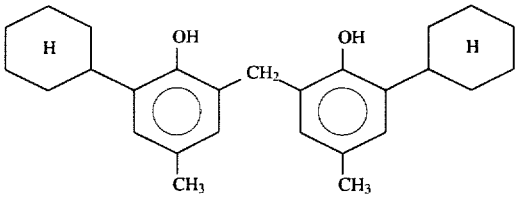
(A-18)
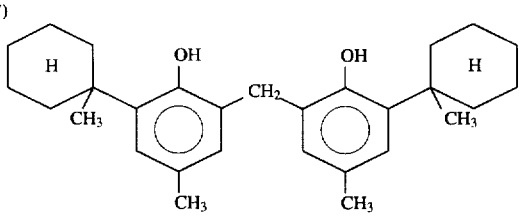
(A-19)
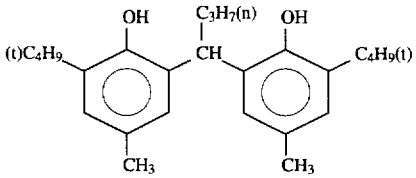
(A-20)
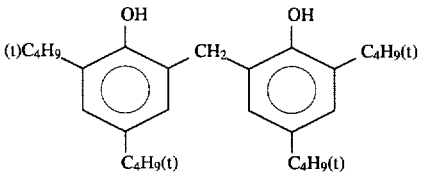
(A-21)
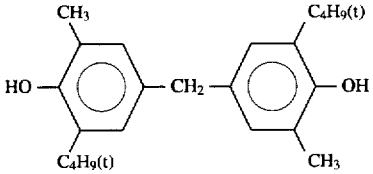
(A-22)
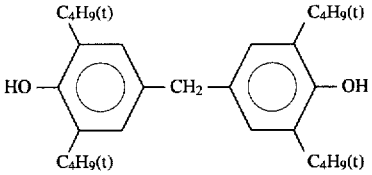
(A-23)
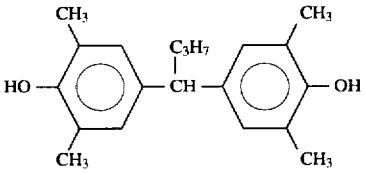
(A-24)
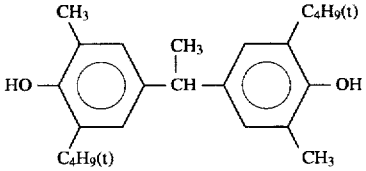
(A-25)
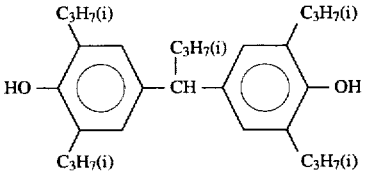
(A-26)
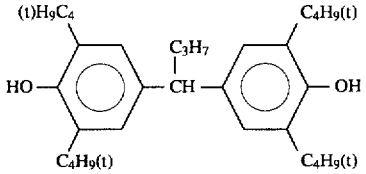
(A-27)
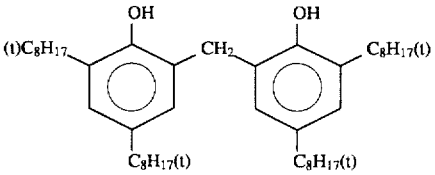
(A-28)
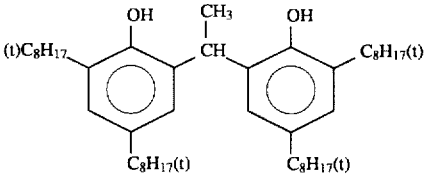
(A-29)
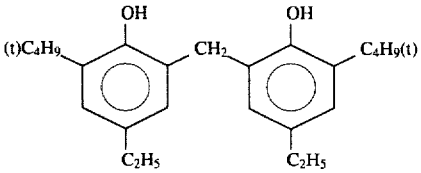
(A-30)
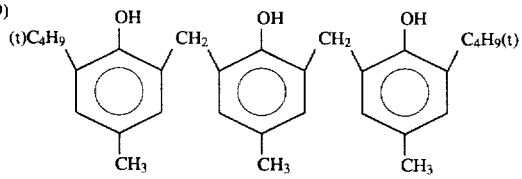
(A-31)
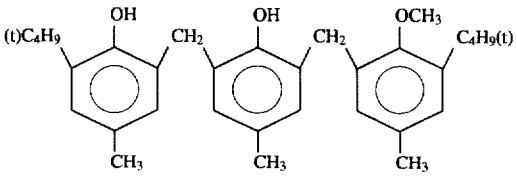
(A-32)
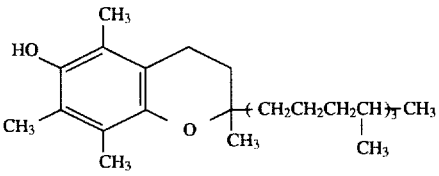

-continued (A-33)

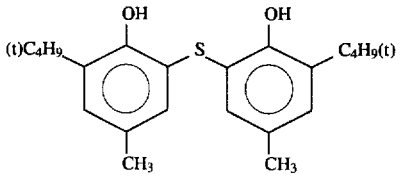

(A-34)

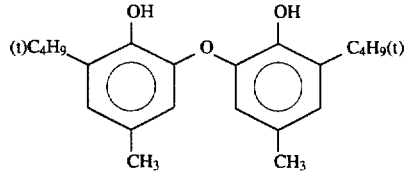

(A-35)

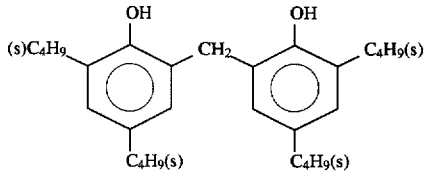

(A-36)

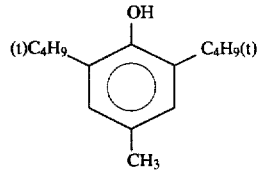

(A-37)

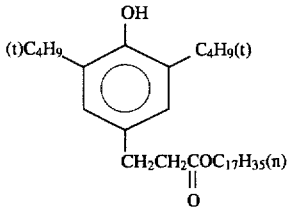

(A-38)

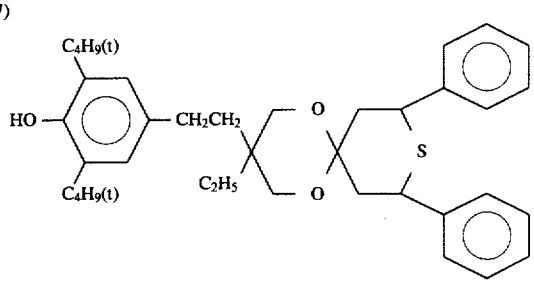

(A-39)

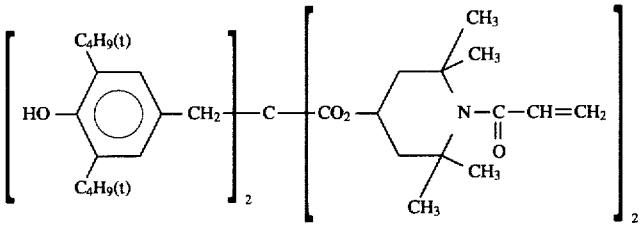

(A-40)

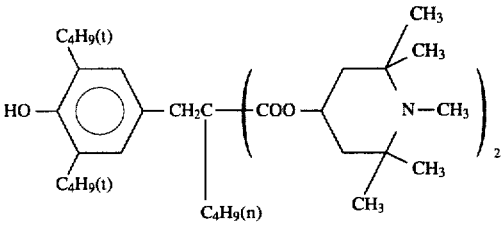

(A-41)

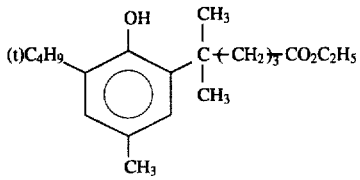

The compounds represented by the formula (A) may be incorporated into any layers in the photographic material but, preferably, they are incorporated into the color-sensitive layer that is positioned remotest from the support.

For adding the compounds to the photographic material, they may be dissolved in water, alcohols, esters or ketones or mixed solvents thereof and then the resulting solutions may be added thereto. If desired, they may be dissolved in high boiling point organic solvents and then added to the photographic material in the form of their dispersions. The latter is preferred for oil-soluble compounds represented by the formula (A), since the compounds added may easily be fixed to the layers containing them. Preferred is a method of adding the compounds along with couplers by so-called co-emulsification.

The amount of the compounds represented by the formula (A) to be added is preferably from $1\times10^{-4}$ to 10 mol, more preferably from $1\times10^{-3}$ to 1 mol, further more preferably from $5\times10^{-3}$ to $1\times10^{-1}$ mol, per mol of the silver halide to be in the layer to which the compounds are added.

The compounds represented by the formula (A) may be incorporated in any site of the photographic materials of the present invention but are preferably incorporated into the negative silver halide emulsion layers or their adjacent layers, most preferably into the negative silver halide emulsion layers. The negative silver halide emulsions as referred to herein mean, as well known by those skilled in the art, such that silver halide grains therein that have been exposed more give larger amounts of developed silver or dyes directly formed by development. The present invention is preferably applied to negative silver halide color photographic materials.

It is not always necessary that the compounds represented by the formula (A) for use in the present invention are in the same layer containing the silver halide emulsion having a mean grain size of 0.25 μm or smaller for use in the present invention, but it is more preferred that the compounds are in the same layer containing the emulsion.

The compounds represented by the formula (A) for use in the present invention should be used only for controlling the variation of the photographic properties of the exposed photographic materials with the lapse of time. Therefore, they are needed to have no bad influence on the other photographic properties of the photographic materials to which they are added. The inventor of the present invention found, in the process of an experiments, some other compounds than the compounds represented by the formula (A) that may prevent in some degree the variation of the photographic properties of exposed photographic materials with the lapse of time, but many of them were not sufficiently effective or caused fogging or desensitization during the addition thereof or during the storage of the photographic materials to which they were added. It has been found that only the compounds represented by the formula (A) are especially effective in preventing the variation of the photographic properties of the exposed photographic materials with the lapse of time, without having any bad influence on the photographic materials and, surprisingly, it has been further found that the thus-selected compounds represented by the formula (A) are additionally effective in preventing the unfavorable phenomenon of the increase in the fog of the photographic materials during the storage thereof.

It is more preferred that the compounds represented by the formula (A) for use in the present invention do not substantially react with the oxidation product of the color developing agent to be in the color developer that is used for developing the photographic materials of the present invention. If they react with the oxidation product of the color developing agent, they will adversely act to lower the sensitivity and the contrast of the photographic materials. In this connection, the gallic acid compounds as disclosed in JP-B-43-4133 (the term "JP-B" as used herein means an "examined Japanese patent publication") that have been known to be able to prevent non-exposed photographic films from fogging during storage and Antioxidant (32) that has been used in Example 3 of JP-A-57-176032 as an antioxidant for improving the stability of the photographic properties of the exposed photographic material react with the oxidation product of a color developing agent. The compounds represented by the formula (A) for use in the present invention do not substantially react with the oxidation product of a color developing agent during the color development of the photographic materials containing the compounds, which means that the photographic properties of the photographic material that has been exposed and then immediately developed do not substantially vary with or without the addition of the compound represented by the formula (A) to the photographic material. The wording "do not substantially vary with or without the addition of the compound represented by the formula (A) to the photographic material" as referred to herein means that the variation in the sensitivity with or without the addition of the compound is not more than 0.1 logE, more preferably not more than 0.05 logE.

The silver halide emulsion to be in at least one of the blue-sensitive, green-sensitive and red-sensitive layers constituting the photographic material of the present invention has a mean grain size of 0.25 μm or smaller. The grain size as referred to herein indicates the diameter of the circle having an area equivalent to the projected area of the grain to be measured when the silver halide emulsion is observed with a microscope or an electron microscope. The mean value as referred to herein is a number average value. The preferred mean grain size of the emulsion is from 0.01 to 0.20 μm, more preferably from 0.05 to 0.15 μm, further more preferably larger than 0.10 μm and not larger than 0.15 μm. If it is lower than the defined range, the sensitivity of the photographic material will lower noticeably. However, if it is more than the same, the intended graininess could not be obtained.

Next, the emulsion of such fine grains which is specifically employed in the present invention will be explained below.

It has been found that when the mean grain size of the emulsion is 0.10 μm or smaller, the effect of improving the variation with the lapse of time of photographic properties of the exposed photographic materials due to the compounds represented by formula (A) according to the present invention is apt to lower.

Any silver halide of silver bromide, silver iodobromide, silver iodochlorobromide, silver chlorobromide and silver chloride may be used in the photographic emulsion layers constituting the photographic material of the present invention. Of these, preferred are silver iodobromide having a silver iodide content of 30 mol % or less (including 0 mol %), and silver bromide, silver chlorobromide and silver chloroiodobromide. More preferred are silver iodobromide and silver chloroiodobromide.

The silver halide grains to be used in the present invention may be either normal crystals having no twin plan or twin crystals chosen from among the examples explained in Bases in Photographic Industry, Part of Silver Salt Photography (edited by Photographic Society of Japan, published by Corona Publishing Co.), page 163, such as mono-layered twin crystals having one twin plane, parallel multi-layered twin crystals having two or more parallel twin planes and nonparallel multi-layered twin crystals having two or more nonparallel twin planes, in accordance with the intended object. As normal crystals, usable are cubic crystals having (100) planes, octahedral crystals having (111) planes, and dodecahedral crystals having (110) planes such as those described in JP-B-55 -42737 and JP-A-60-222842. In addition, also usable are (h11) grains such as typically (211) grains, (hh1) grains such as typically (331) grains, (hk0) grains such as typically (210) grains an (hk1) grains such as typically (321) grains, for example those described in Journal of Imaging Science, Vol. 30, page 247 (1986), though some modification is needed in preparing the grains. The grains of these types may be selected in accordance with the intended object. Further usable in the present invention are grains having two or more different planes, such as tetradecahedral grains having both (100) and (111) planes, grains having both (100) and (110) planes or grains having both (111) and (110) planes. The grains of these types may be selected in accordance with the intended object. In the present invention, especially preferred are cubic grains having (100) planes, tetradecahedral grains having both (100) and (111) planes and tabular grains.

The object of the present invention may be attained by employing silver halide grains having a mean grain size of 0.25 μm or smaller, preferably 0.2 μm or smaller, more preferably 0.15 μm or smaller. The grain size as referred to herein indicates the diameter of the circle having an area equivalent to the projected area of the grain. The mean value as referred to herein is a number average value.

The silver halide emulsion may be either a monodisperse emulsion having a narrow grain size distribution or a polydisperse emulsion having a broad grain size distribution.

A so-called monodisperse silver halide emulsion having a narrow grain size distribution where at least 80% by weight or by number of the total of the grains have a grain size fall within the range of the mean grain size ±30% is preferably employed in the present invention. In order to make the photographic material of the present invention have the intended gradation, it is possible that two or more monodisperse silver halide emulsions each having a different mean grain size are mixed and incorporated into one color-sensitive emulsion layer or are incorporated into different emulsion layers substantially having the same color-sensitivity. In addition, it is also possible to employ two or more polydisperse silver halide emulsions or a combination of monodisperse emulsion(s) and polydisperse emulsion(s), whereupon these emulsions may be mixed and incorporated into one layer or may be individually incorporated into plural layers.

The silver halide photographic emulsion for use in the present invention may be prepared by known methods, for example, by those described in P. Glafkides, *Chimie et Physique Photographique* (published by Paul Montel Co., 1967), G. F. Duffin, *Photographic Emulsion Chemistry* (published by Focal Press Co., 1966), and V. L. Zelikman et al, *Making and Coating Photographic Emulsion* (published by Focal Press Co., 1964). For instance, they may be prepared by any of an acid method, a neutral method or an ammonia method. As a system of reacting a soluble silver salt and soluble halogen salt(s), any of a single jet method, a double jet method and a combination of them may be employed. A so-called reverse mixing method may also be employed, in which silver halide grains are formed in an atmosphere of having excess silver ions. As one system of a double jet method, a so-called controlled double jet method in which the silver ion concentration (pAg) in the liquid phase of forming silver halide grains is kept constant may also be employed. In accordance with the method, silver halide grains each having a regular crystalline form and having a nearly uniform grain size can be obtained.

The silver halide emulsion comprising the above-mentioned regular grains may be obtained by controlling the pAg and pH values in the system of forming the grains. The details of the formation of the regular grains are described in, for example, *Photographic Science and Engineering*, Vol. 6, pp. 159 to 165 (1962); *Journal of Photographic Science*, Vol. 12, pp. 242 to 251 (1964); U.S. Pat. No. 3,655,394 and British Patent 1,413,748.

Tabular grains having an aspect ratio of 3 or more may also be employed in the present invention. Tabular grains may easily be prepared by known methods, for example, by those described in Cleve, *Photography, Theory and Practice* (1930), page 131; Gutoff, *Photographic Science and Engineering*, Vol. 14, pp. 248 to 257 (1970); and U.S. Pat. Nos. 4,434,226, 4,414,310, 4,433,048 and 4,439,520 and British Patent 2,112,157. Tabular grains are advantageous, as the covering power of the emulsion containing them is high and the color-sensitizing effect of the sensitizing dyes in the emulsion containing them is enhanced. The details of the use of tabular grains are described in the above-mentioned U.S. Pat. No. 4,434,226.

Regarding the crystal structure of the silver halide grains, the grains may have the same halogen composition throughout the whole grain, or they may have different halogen compositions between the inside part and the outside part of one grain, or they may have a layered structure. These crystal structures of emulsion grains are described in, for example, British Patent 1,027,146, U.S. Pat. Nos. 3,505,068 and 4,444,877 and JP-A-60-143331. Further, the grains may have different halogen compositions as conjugated by epitaxial junction, or they may have other compounds than silver halides, such as silver rhodanide or lead oxide, as conjugated with the silver halide matrix.

Regarding the halogen compositions of the grains in the silver halide emulsion for use in the present invention, it is preferred that plural halogen compositions are distributed or layered in one grain. As one typical example, mentioned are core/shell type or two-layered grains in which the core and the surface layer have different halogen compositions, such as those disclosed in JP-B-43-13162, JP-A-61-215540, JP-A-60-222845 and JP-A-61-75337. The shape of the shell-coated complete grain may be either the same as or different from that of the nude core. For instance, using cubic cores, either octahedral shell-coated grains or cubic shell-coated grains may be formed. On the other hand, using octahedral cores, either cubic shell-coated grains or octahedral shell-coated grains may be formed. Though using definite regular cores, somewhat irregular shell-coated grains or amorphous shell-coated grains are often formed. Such two-layered grains are not limitative, but three-layered or more multi-layered grains, such as those described in JP-A- 60-222844, as well as composite grains to be prepared by further coating core-shell two-layered grains with a thin, different silver halide layer may also be employed.

For producing multi-layered grains, the above-mentioned coating method for completely wrapping the core is not limitative but a conjugating method for forming so-called conjugate grains may also be employed. Examples of such conjugate grains are described in, for example, JP-A-59-133540, JP-A-58-108526, EP-A-199290, JP-B-58-24772 and JP-A-59-16254. The crystal moiety to be conjugated to the host crystal has a halogen composition different from that of the host crystal, and it is conjugated at the edges, corners or planes of the host crystal to form a conjugate grain. Such conjugation may be conducted either on host crystals having a uniform halogen composition or core/shell host crystals.

It is natural that both the host part and the guest part to be conjugated on the host part have silver halide grains, which, however, it not limitative. If desired, silver salt compounds different from silver halides but having no rock salt structure, such as silver rhodanide or silver carbonate, may also be combined with silver halides to form conjugate grains. Also employable are non-silver compounds such as PbO for forming conjugate grains, if possible.

In the silver iodobromide grains having any of the above-mentioned structures, for example core/shell silver iodobromide grains, the silver iodide contents in the constitutive parts are not limited. For example, the silver iodide content in the core part may be higher while that in the shell part is lower; or alternatively, the silver iodide content in the core part may be lower while that in the shell part is higher. The same shall apply to conjugate grains. For example, the silver iodide content in the host crystal may be higher while that in the conjugated guest part is relatively lower; or vice versa.

The boundary between the parts each having a different halogen composition in the grains having any of the above-mentioned structures may have or may not have a definite interface. In the latter case, mixed crystals may be formed in the interface due to the difference in the halogen compositions therein. If desired, the interface may have positive gradation of the halogen composition.

The grains to be in the silver halide emulsion for use in the present invention may be rounded to roundish grains such as those described in EP-B-009672 and EP-B-0064412, or the surfaces of the grains may be modified by the method described in German Patent 2306447C2 and JP-A-60-221320.

The silver halide emulsion for use in the present invention is preferably of a surface latent image type, but it may also be of an internal latent image type if the developer to be used as well as the condition for the development is suitably selected. If desired, an emulsion of a shallow internal latent image type, that is prepared by coating a thin layer over the grains, may also be employed in the present invention in accordance with the intended object.

For promoting the ripening of the emulsion for use in the present invention, silver halide solvents are advantageously used. For instance, it is known to add an excess amount of halide ions to the reactor so as to promote the ripening of the emulsion prepared therein. Accordingly, it is obvious that the ripening of the emulsion may be promoted only by adding halide solutions to the reactor. Other ripening agents may also be used. All the necessary amount of the ripening agent may be added to the dispersing medium in the reactor prior to addition of the silver salt and the halide thereto; or alternatively, the ripening agent may be added to the reactor along with addition of one or more halides, silver salt or peptizer thereto. As another modified embodiment, the ripening agent may be added to the reactor independently of the addition of the halide and the silver salt thereto.

As other usable ripening agents than halide ions, mentioned are ammonia, amine compounds, and thiocyanates, for example alkali metal thiocyanates, especially sodium and potassium thiocyanates, and ammonium thiocyanates.

Preferably, the silver halide emulsion for use in the present invention is subjected to reduction sensitization, during the formation of the grains, after the formation of them and before or during the chemical sensitization of them, or after the chemical sensitization of them.

For the reduction sensitization, employable are a method of adding a reduction sensitizer to the silver halide emulsion, a so-called silver-ripening method where the grains are grown or ripened in a low-pAg atmosphere having a pAg value of from 1 to 7, and a so-called high pH-ripening method where the grains are grown or ripened in a high-pH atmosphere having a pH value of from 8 to 11. Any of the methods may be selected. If desired, two or more of them may be combined.

The method of adding a reduction sensitizer is preferred, since the level of the reduction sensitization may be adjusted delicately.

As the reduction sensitizer, known are stannous salts, ascorbic acid and its derivatives, amines and polyamines, hydrazine derivatives, formamidinesulfinic acids, silane compounds, borane compounds, etc. Any of these known reduction sensitizers may be employed in the present invention. If desired, two or more of them may be used as combined. As the reduction sensitizer, preferred are stannous chloride, thiourea dioxide, dimethylaminoborane, ascorbic acid and its derivatives. The amount of the reduction sensitizer to be added depends upon the conditions for producing the emulsion and shall be selected in accordance with the conditions. Suitably, it is from $10^{-7}$ to $10^{-3}$ mol per mol of the silver halide to be treated therewith.

The reduction sensitizer is dissolved in solvents such as water, alcohols, glycols, ketones, esters, amides, etc., and the resulting solution is added during the growth or the grains. It may be previously added to the reactor, but it is preferably added thereto at a suitable time while the grains are growing. If desired, the reduction sensitizer may be previously added to the water-soluble silver salt or the aqueous solution of a water-soluble alkali halide, which are reacted to precipitate silver halide grains. A solution of the reduction sensitizer may be divided into plural parts, which are intermittently added to the reactor in accordance with the growth of the silver halide grains therein. Preferably, the solution may be added to the reactor continuously for a long period of time.

The photographic material of the present invention is not specifically defined, provided that it has at least one blue-sensitive silver halide emulsion layer, at least one green-sensitive silver halide emulsion layer and at least one red-sensitive silver halide emulsion layer on a support. In the photographic material, the number of the silver halide emulsion layers and light-insensitive layers as well as the order of the layers on the support is not specifically defined. As one typical example, there is mentioned a silver halide color photographic material having at least one light-sensitive layer(s) each composed of plural silver halide emulsion layer each having a substantially same color-sensitivity but having a different sensitivity degree on a support. The respective light-sensitive layer is unit light-sensitive layer having a color-sensitivity to anyone of blue light, green light and red light. In such a multi-layer silver halide color photographic material, in general, the order of the unit light-sensitive layers to be on the support comprises a red-sensitive layer unit, a green-sensitive layer unit and a blue-sensitive layer unit as formed on the support in this order. As the case may be, however, the order may be opposite to the above-mentioned one, in accordance with the object of the photographic material. As still another embodiment, a different color-sensitive layer may be sandwiched between other two and the same color-sensitive layers.

Various light-insensitive layers such as interlayer may be provided between the above-mentioned silver halide light-sensitive layers, or on or below the uppermost layer or lowermost layers.

Such an interlayer may contain various couplers and DIR compounds described in JP-A-61-43748, JP-A-59 -113438, JP-A-59-113440, JP-A-61-20037 and JP-A-61-20038, and it may also contain conventional color stain preventing agents.

As the constitution of the plural silver halide emulsions of constituting the respective light-sensitive layer units, preferred is a two-layered constitution composed of a high-sensitivity emulsion layer and a low-sensitivity emulsion layer as described in German Patent 1,121,470 and British Patent 923,045. In general, it is preferred that the plural light-sensitive layers are arranged on the support in such a way that the sensitivity degree of the layer is to gradually decrease in the direction to the support. In the embodiment, a light-insensitive layer may be provided between the plural silver halide emulsion layers. As another embodiment, a low-sensitivity emulsion layer is formed remote from the support and a high-sensitivity emulsion layer is formed near to the support, as so described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56 -25738 and JP-A-62-63936.

As further example, there is mentioned a three-layer unit constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity degree of each emulsion layer is gradually lowered to the direction of the support. Even in the three-layer constitution of the type, each of the same color-sensitivity layers may be composed of three layers of middle-sensitivity emulsion layer/high-sensitivity emulsion layer/low-sensitivity emulsion layer as formed in this order from the remotest side from the support, as so described in JP-A-59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer. Where the photographic material of the present invention has four or more layers, the layer constitution thereof may be varied in accordance with the manner mentioned above.

In order to improve the color reproducibility, it is desired to provide a donor layer (CL) of an interlayer effect which has a different color sensitivity distribution from that of the essential light-sensitive layers of BL, GL and RL, adjacent to or near to the essential light-sensitive layers, in the manner as described in U.S. Pat. Nos. 4,663,271, 4,705,744 and 4,707,436, JP-A-62-160448 and JP-A-63-89850.

As mentioned above, various layer constitutions and arrangements may be selected in accordance with the object of the photographic material of the present invention.

Other silver halides than the fine silver halide grains having a mean grain size of 0.25 μm or smaller mentioned above, which may be employed in the present invention along with the fine grains, will be mentioned below.

The silver halide to be preferably in the photographic emulsion layer of constituting the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 25 mol %.

The silver halide grains to be in the photographic emulsion of constituting the photographic material of the present invention may be regular crystalline ones such as cubic, octahedral or tetradecahedral grains, or irregular crystalline ones such as spherical or plate-like grains, or irregular crystalline ones having a crystal defect such as a twin plane, or composite crystalline ones composed of the above-mentioned regular and irregular crystalline forms.

Regarding the grain size of the silver halide grains, the grains may be fine grains having a small grain size of about 0.2 μm or smaller or may be large ones having a large grain size of up to about 10 μm as the diameter of the projected area. The emulsion of the grains may be either a polydisperse emulsion or a monodisperse emulsion.

The silver halide photographic emulsions to be used in the present invention may be prepared by various methods, for example, those described in *Research Disclosure* (RD) No. 17643 (December, 1978), pages 22 to 23 (I. Emulsion Preparation and Types); RD No. 18716 (November, 1979), pages 648; RD No. 307105 (November 1989), pages 863 to 865; P. Glafkides, *Chimie et Physique Photographique* (published by Paul Montel, 1967); G. F. Duffin, *Photographic Emulsion Chemistry* (published by Focal Press, 1966); and V. L. Zelikman et al, *Making and Coating Photographic Emulsion* (published by Focal Press, 1964).

Monodisperse emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with various methods, for example, as described in Gutoff, *Photographic Science and Engineering*, Vol. 14, pages 248 to 257 (1970); and U.S. Pat. Nos. 4,434,226, 4,414,310, 4,433,048 and 4,439,520 and British Patent 2,112,157.

Regarding the crystal structure of the silver halide grains of constituting the emulsions for use in the present invention, the grains may have the same halogen composition throughout the whole grain, or they may have different halogen compositions between the inside part and the outside part of one grain, or they may have a layered structure. Further, the grains may have different halogen compositions as conjugated by epitaxial junction, or they may have other compounds than silver halides, such as silver rhodanide or lead oxide, as conjugated with the silver halide matrix. Additionally, a mixture of various grains of different crystalline forms may be employed in the present invention.

The above-mentioned emulsions for use in the present invention may be either surface latent image type ones of forming latent images essentially on the surfaces of the grains or internal latent image type ones of forming latent images essentially in the insides of them, or may also be surface/inside latent image type ones of forming a latent images both on the surfaces of the grains and in the insides of them. Anyhow, the emulsions are needed to be negative emulsions. As internal latent image type emulsions, they may be internal latent image type core/shell emulsions as described in JP-A-63-264740. A method of preparing such internal latent image type core/shell emulsions is described in JP-A-59-133542. The thickness of the shell of the emulsion grains of the type varies, depending upon the way of developing them, and is preferably from 3 to 40 nm, especially preferably from 5 to 20 nm.

The silver halide emulsions for use in the present invention are generally physically ripened, chemically ripened and/or color-sensitized. Additives to be used in such a ripening or sensitizing step are described in *Research Disclosure* Nos. 17643, 18716 and 307105, and the related descriptions in these references are shown in the table mentioned below.

In the photographic material of the present invention, two or more emulsions which are different from one another in at least one characteristic of light-sensitive silver halide grains of constituting them, which is selected from the grain size, the grain size distribution, the halogen composition, the shape and the sensitivity of the grains, can be incorporated into one and the same layer.

Surface-fogged silver halide grains as described in U.S. Pat. No. 4,082,553; inside-fogged silver halide grains as described in U.S. Pat. No. 4,626,498 and JP-A-59 -214852; as well as colloidal silver may preferably be used into light-sensitive silver halide emulsion layers and/or substantially light-insensitive hydrophilic colloid layers of constituting the photographic material of the present invention. Inside-fogged or surface-fogged silver halide grains are such grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A-59-214852.

The silver halide of forming the inside nucleus of an inside-fogged core/shell type silver halide grain may be either one having the same halogen composition or one having a different halogen composition. The inside-fogged or surface-fogged silver halide may be any of silver chloride, silver chlorobromide, silver iodobromide or silver chloroiodobromide. The grain size of such a fogged silver halide grain is not specifically defined, and it is preferably from 0.01 to 0.75 μm, especially preferably from 0.05 to 0.6 μm, as a mean grain size. The shape of the grain is not also specifically defined, and it may be either a regular grain or an irregular grain. The emulsion containing such fogged grains may be either a monodisperse one or a polydisperse one. Preferred is a monodisperse one, in which at least 95% by weight or by number of all the silver halide grains therein have a grain size to fall within the range of the mean grain size ±40%.

The photographic material of the present invention preferably contain light-insensitive fine silver halide grains. Light-insensitive fine silver halide grains are meant to be fine silver halide grains which are not sensitive to the light as imparted to the photographic material during imagewise exposure thereof for forming dye image and are substantially not developed in the step of development of the exposed material. These fine grains are desired not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains are desired to have a mean grain size (as a mean value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In the case, the surfaces of the fine silver halide grains to be prepared do not need to be chemically sensitized and color sensitization of the grains is unnecessary. However, prior to addition of the fine grains to the coating composition, it is desired to previously add a known stabilizer, such as triazole compounds, azaindene compounds, benzothiazolium compounds or, mercapto compound or zinc compounds, to the coating composition. The fine silver halide grains-containing layer may preferably contain colloidal silver.

The amount of silver as coated in the photographic material of the present invention is preferably 6.0 g/m$^2$ or smaller, most preferably 4.5 g/m$^2$ or smaller.

Various known photographic additives which may be used in preparing the photographic materials of the present invention are mentioned in the above-mentioned three *Research Disclosures*, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Color Sensitizer | pages 23 to 24 | page 648, right column to page 649, right column | pages 866 to 868 |
| Supersensitizer | pages 23 to 24 | page 648, right column to page 649, right column | pages 866 to 868 |
| 4 Brightening Agent | page 24 | page 649, right column | page 868 |
| 5 Anti-foggant | pages 24 to 25 | page 649, right column | pages 868 to 870 |
| Stabilizer | pages 24 to 25 | page 649, right column | pages 868 to 870 |
| 6. Light Absorbent | pages 25 to 26 | page 649, right column to page 650, left column | page 873 |
| Filter Dye | pages 25 to 26 | page 649, right column to page 650, left column | page 873 |
| Ultraviolet Absorbent | pages 25 to 26 | page 649, right column to page 650, left column | page 873 |
| 7 Stain Inhibitor | page 25, right column | page 650, left column to right column | page 872 |
| 8 Color Image Stabilizer | page 25 | page 650, left column | page 872 |
| 9 Hardening Agent | page 26 | page 651, left column | pages 874 to 875 |
| 10 Binder | page 26 | page 651, left column | page 873 to 874 |
| 11 Plasticizer | page 27 | page 650, right column | page 876 |
| Lubricant | page 27 | page 650, right column | page 876 |
| 12 Coating Aid | pages 26 to 27 | page 650, right column | pages 875 to 876 |
| Surfactant | pages 26 to 27 | page 650, right column | pages 875 to 876 |
| 13 Antistatic Agent | page 27 | page 650, right column | pages 876 to 877 |
| 14 Matting Agent | | | pages 878 to 879 |

In order to prevent deterioration of the photographic property of the photographic material of the present invention by formaldehyde gas as imparted thereto, compounds capable of reacting with formaldehyde so as to fix it, for example, those described in U.S. Pat. Nos. 4,411,987 and 4,435,503, are preferably incorporated into the photographic material.

It is preferred to incorporate mercapto compounds described in U.S. Pat. Nos. 4,740,454 and 4,788,132 and JP-A-62-18539 and JP-A-1-283551 into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver as formed by development, which are described in JP-A-1 -106052.

It is also preferred to incorporate, into the photographic materials of the present invention, dyes as dispersed by the method described in Published Unexamined International Application No. WO88/04794 and Published Unexamined International Application No. 1-502912, or dyes as described in EP-A-317308, U.S. Pat. No. 4,420,555 and JP-A-1-259358.

Various color couplers can be incorporated into the photographic material of the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and EP-A-249473 are preferred.

As magenta couplers, 5-pyrazolone compounds and pyrazoloazole compounds are preferred. For instance, those described in U.S. Pat. Nos. 4,310,619 and 4,351,897, European Patent 73,636, U.S. Pat. Nos. 3,061,432 and 3,725,067, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and Published Unexamined International Application No. WO88/04795 are especially preferably used in the present invention.

As cyan couplers, usable are phenol couplers and naphthol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199, and JP-A-61-42648. In addition, pyrazoloazole couplers described in JP-A-64-553, JP-A-64-554, JP-A-64-555 and JP-A-64-556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320 and 4,576,910, British Patent 2,102,137 and EP-A-341188.

Couplers capable of forming a colored dyes having a proper diffusibility may also be used, and those described in U.S. Pat. No. 4,366,237, British Patent 2,125,570, European Patent 96,570, and West German Patent Application (OLS) No. 3,234,533 are preferred.

As colored couplers for correcting the unnecessary absorption of colored dyes, those described in RD No. 17643, VII-G, RD No. 307105, VII-G, U.S. Pat. No. 4,163,670, JP-B-57-39413, U.S. Pat. Nos. 4,004,929 and 4,138,258, and British Patent 1,146,368 are preferred. Additionally, couplers of correcting the unnecessary absorption of the colored dyed by the phosphor dye to be released during coupling, as described in U.S. Pat. No. 4,774,181, as well as couplers having a dye precursor group capable of reacting with a developing agent to form dyes, as a split-off group, as described in U.S. Pat. No. 4,777,120 are also preferably used.

Compounds capable of releasing a photographically useful residue along with coupling may also be used in the present invention. For instance, as DIR couplers of releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 and 4,782,012 are preferred.

Couplers of releasing a bleaching accelerator, as described in RD No. 11449 (October, 1973), RD 24241 (June, 1984) and JP-A-61-201247, are effective for shortening the time for the processing step with a processing solution having a bleaching capacity, and the effect is especially noticeable when they are added to the photographic material of the present invention of containing the above-mentioned tabular silver halide grains.

As couplers of imagewise releasing a nucleating agent or development accelerator during development, those described in British Patents 2,097,140 and 2,131,188, and JP-A-59-157638 and JP-A-59-170840 are preferred. In addition, compounds of releasing a foggant, a development accelerator or a silver halide solvent by redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers described in U.S. Pat. No. 4,130,427; poly-valent couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers of releasing a dye which recolors after released from the coupler, as described in EP-A-173302 and EP-A-313308; ligand-releasing couplers described in U.S. Pat. No. 4,553,477; leuco dye-releasing couplers described in JP-A-63-75747; and couplers of releasing a phosphor dye as described in U.S. Pat. No. 4,774,181.

The above-mentioned couplers can be incorporated into the photographic materials of the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate, bis(1,1-diethylpropyl)phthalate), phosphates or phosphonates (e.g., triphenyl phosphate, tricresyl phosphate, 2-ethylhexyl ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl)sebacate, dioctyl azelate, glycerol tributylate, isostearyl lactate, trioctyl citrate), aniline derivatives (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of about 30° C. or higher, preferably from 50° to about 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps of carrying out the dispersion method, the effect of the method and examples of latexes usable in the method for impregnation are described in U.S. Pat. No. 4,199,363, West German Patent Application (OLS) Nos. 2,541,174 and 2,541,230.

The color photographic material of the present invention preferably contains an antiseptic or fungicide of various kinds, for example, selected from phenethyl alcohol and those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)-benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers as provided on the surface of the support of having emulsion layers is 28 μm or less, preferably 23 μm or less, more preferably 18 μm or less, especially preferably 16 μm or less, in the photographic material of the present invention. It is also desired that the photographic material of the present invention has a film swelling rate ($T_{1/2}$) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate ($T_{1/2}$) is defined as follows: 90% of the maximum swollen thickness of the photographic material as processed in a color developer under the condition of 30° C. and 3 minutes and 15 seconds is called a saturated swollen thickness. The time necessary for attaining a half (½) of the saturated swollen thickness is defined to be a film swelling rate ($T_{1/2+1}$).

The film swelling rate ($T_{1/2}$) can be adjusted by adding a hardening agent to gelatin of a binder or by varying the condition of storing the coated photographic material. Additionally, the photographic material of the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

It is preferred that the photographic material of the present invention has a hydrophilic colloid layer having a total dry thickness of from 2 μm to 20 μm on the side opposite to the side of having the emulsion layers. The layer is referred to as a backing layer. It is preferred that the backing various layer contains additives of the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution containing, as a main component, an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, as well as sulfates, hydrochlorides and p-toluenesulfonates of the compounds. Above all, especially preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4hydroxybutyl)aniline, and their hydrochlorides, p-toluenesulfonates and sulfates. These compounds can be used in combination of two or more of them, in accordance with the object.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediaminetetraacetic acid, nitrilotriacetic acid, diethylenetriaminepentaacetic acid, cyclohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and their salts.

Where the photographic material is subjected to reversal processing, in general, it is first subjected to black-and-white development and then subjected to color development. For the first black-and-white development is used a black-and-white developer, which contains a conventional black-and-white developing agent, for example, dihydroxybenzenes such as hydroquinone, 3-pyrazolidones such as 1-phenyl-3-pyrazolidone, or aminophenols such as N-methyl-p-aminophenol, singly or in combination of them. The color developer and the black-and-white developer generally has a pH value of from 9 to 12. The amount of the replenisher to the developer is, though depending upon the color photographic material to be processed, generally 3 liters or less per $m^2$ of the photographic material to be processed. It may be reduced to 500 ml or less per $m^2$ of the photographic material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

$$\text{Opening Ratio } (cm^{-1}) = (\text{Contact Surface Area } (cm^2) \text{ of Processing Solution with Air}) / (\text{Volume } (cm^3) \text{ of Processing Tank})$$

The above-mentioned opening ratio is preferably 0 1 or less $cm^{-1}$, more preferably from 0.001 to 0.05 $cm^{-1}$. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A- 63-216050. Reduction of the opening ratio is preferably applied to not only the both steps of color development and black-and-white development but also all the subsequent steps such as bleaching, bleach-fixation, fixation, washing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the processing solution.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol etherdiaminetetraacetic acid or with organic acids such as citric acid, tartaric acid or malic acid. Among them, aminopolycarboxylato iron(III) complexes such as ethylenediaminetetraacetato iron(III) complex and 1,3-diaminopropanetetraacetato iron(III) complex are preferred in view of the rapid processability thereof and of prevention of environmental pollution. The aminopolycarboxylato iron(III) complexes are especially useful both in a bleaching solution and in a bleach-fixing solution. The bleaching solution or bleach-fixing solution containing such aminopolycarboxylato iron(III) complexes generally has a pH value of from 4.0 to 8.0, but the solution may have a lower pH value for rapid processing.

The bleaching solution, the bleach-fixing solution and the previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, West German Patents 1,290,812 and 2,059,988, JP-A-53-32736, JP-A-53-57831, JP-A- 53-37418, JP-A-53-72623, JP-A-53-95630, JP-A-53-95631, JP-A-53-104232, JP-A-53-124424, JP-A-53-141623 and JP-A-53-28426, RD No. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in West German Patent 1,127,715 and JP-A-58-16235; polyoxyethylene compounds as described in West German Patents 966,410 and 2,748,430; polyamine compounds as described in JP-B-45-8836; other compounds as described in JP-A-49-40943, JP-A-49-59644, JP-A-53-94927, JP-A-54 -35727, JP-A-55-26506 and JP-A-58-163940; and bromide ions. Above all, mercapto group- or disulfide group-containing compounds, in particular, those as described in U.S. Pat. No. 3,893,858, West German Patent 1,290,812 and JP-A-53-95630 are preferred, as having a large accelerating effect. In addition, compounds described in U.S. Pat. No. 4,552,834 are also preferred. These bleaching accelerators may be incorporated into the photographic material of the present invention. Where the photographic material of the present invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the present invention, usable are thiosulfates, thiocyanates, thioether compounds, thioureas, and a large amount of iodide salts. Use of thiosulfates is general for the purpose. Above all, ammonium thiosulfate is most widely used. Additionally, combination of thiosulfates and thiocyanates, thioether compounds or thioureas is also preferred. As the preservative to be in the fixing solution or bleach-fixing solution, preferred are sulfites, bisulfites and carbonyl-bisulfite adducts, as well as sulfinic acid compounds as described in EP-A-294769. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contains compounds having a pKa value of from 6.0 to 9.0, for the purpose of adjusting the pH value of the solution. As such compounds, preferably added are imidazoles such as imidazole, 1-methylimidazole, 1-ethylimidaozle or 2-methylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed photographic material may effectively be prevented.

In the desilvering process, it is desired that stirring of the processing solution during the process is promoted as much as possible. As examples of reinforced stirring means for forcedly stirring the photographic material during the desilvering step, there are mentioned a method of running a jet stream of the processing solution to the emulsion-coated surface of the photographic material, as described in JP-A-62-183460; a method of promoting the stirring effect by the use of a rotating means, as described in JP-A-62-183461; a method of moving the photographic material being processed in the processing bath while the emulsion-coated surface of the photographic material is brought into contact with a wiper blade as provided in the processing bath, whereby the processing solution as applied to the emulsion-coated surface of the photographic material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the photographic material would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material of the present invention can be processed with an automatic developing machine. It is desired that the automatic developing machine to be used for processing the photographic material of the present invention is equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of the reasons, the conveying means is especially effective for shortening the processing time in each processing step and for reducing the amount of the replenisher to each processing bath.

The silver halide color photographic material of the present invention is generally washed in water and/or stabilized, after being desilvered. The amount of the water to be used in the washing step can be set in a broad range, in accordance with the characteristic of the photographic material being processed (for example, depending upon the raw material components, such as the coupler and so on) or the use of the photographic material, as well as the temperature of the washing water, the number of the washing tanks (the number of the washing stages), the replenishment system of concurrent or countercurrent and other various kinds of conditions. Among these conditions, the relation between the number of the washing tanks and the amount of the washing water in a multi-stage countercurrent washing system can be obtained by the method described in *Journal of the Society of Motion Picture and Television Engineers*, Vol. 64, pages 248 to 253 (May, 1955).

According to the multi-stage countercurrent system described in the above-mentioned reference, the amount of the washing water to be used can be reduced noticeably, but because of the prolongation of the residence time of the water in the washing tank, bacteria would propagate in the tank so that the floating substances generated by the propagation of bacteria would adhere to the surface of the photographic material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in Hiroshi Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsu-kai, Japan), and *Encyclopeadia of Bactericidal and Fungicidal Agents*, edited by Nippon Bactericide and Fungicide Association, Japan (1986), can also be used.

The pH value of the washing water to be used for processing the photographic material of the present invention is from 4 to 9, preferably from 5 to 8. The temperature of the washing water and the washing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being washed with water. For the stabilization, any known methods, for example, as described in JP-A-57-8543, JP-A-58-14834 and JP-A-60 -220345, can be employed.

In addition, the photographic material can also be stabilized, following the washing step. As one example of the case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts. The stabilizing bath may also contain various chelating agents and fungicides.

The overflow from the washing and/or stabilizing solutions because of addition of replenishers thereto may be re-used in the other steps such as the previous desilvering step.

Where the photographic material of the present invention is processed with an automatic developing machine system and the processing solutions as being used in the step are evaporated and thickened, it is desired to add water to the solutions so as to correct the concentration of the solutions.

The silver halide color photographic material of the present invention can contain a color developing agent for the purpose of simplifying and accelerating the processing of the photographic material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD No. 14850 (August, 1976) and RD No. 15159 (November, 1976), aldole compounds described in RD No. 13924 (November, 1975), metal complexes described in U.S. Pat. No. 3,719,492 and urethane compounds described in JP-A-53-135628, as the precursors.

The silver halide color photographic material of the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the present invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The silver halide color photographic material of the present invention is especially effectively applied to lens-combined film units such as those described in JP-B-2-32615 and examined Japanese Utility Model Publication No. 3-39784, as easily expressing the effect.

Next, the present invention will be explained in more detail by way of the following examples, which, however, are not intended to restrict the scope of the present invention.

EXAMPLE 1

An aqueous solution of silver nitrate and an aqueous solution of potassium bromide were added to an aqueous solution of gelatin by a controlled double-jet method at pAg of 6.0 and at 70° C. to prepare an emulsion of cubic, pure silver bromide grains having a mean grain size of 0.06 μm. After the formation of the grains, the emulsion was then de-salted by an ordinary method and again dispersed at 48° C. and at pAg of 8.8 and pH of 6.3 to give Emulsion (Em-t).

Using Emulsion (Em-t) as seed crystals, an aqueous solution of silver nitrate and an aqueous solution of a mixture of potassium bromide and potassium iodide were added to an aqueous solution of gelatin by a controlled double-jet method at pAg of 5.8 and at 72° C. This was de-salted and re-dispersed, in the same manner as for Emulsion (Em-t). Accordingly, five emulsions having a mean iodide content of 1.2 mol % and having a mean grain size of 0.40 μm, 0.31 μm, 0.25 μm, 0.18 μm and 0.11 μm, respectively, were prepared.

After the formation of the grains, these were subjected to chemical sensitization at 60° C., using chloroauric acid, potassium thiocyanate and, as a sulfur sensitizing agent, sodium thiosulfate, whereby their sensitivities were optimized. Thus, Emulsions (Em-1) to (Em-5) were prepared.

Using the emulsion thus prepared, a coated sample (No. 101) was formed in the manner mentioned below.

An emulsion layer and a protective layer mentioned below were coated on a triacetyl cellulose film support that had been coated with a subbing layer.

First Layer: Emulsion Layer

| | |
|---|---|
| Emulsion (Em-1) | 0.8 g/m² as Ag |
| Coupler CP-1 | 0.35 g/m² |

-continued

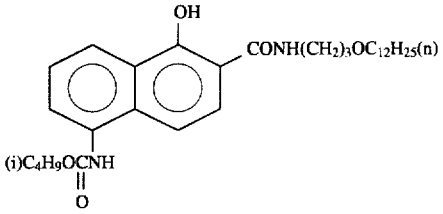

| | |
|---|---|
| Coupler CP-2 | 0.35 g/m² |

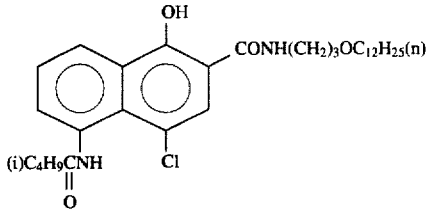

| | |
|---|---|
| Tricresyl Phosphate | 0.6 g/m² |
| Gelatin | 2.5 g/m² |
| Second Layer: Protective Layer | |
| Gelatin | 1.5 g/m² |
| Polymethyl Methacrylate Grains (diameter 2.0 μm) | 0.05 g/m² |
| 2,4-Dichloro-6-hydroxy-S-triazine Sodium Salt | 0.09 g/m² |

In the same manner as in preparation of Sample No. 101 as above, Sample Nos. 102 to 115 shown in Table 1 below were prepared. In Table 1, the amount of the compound represented by formula (A) for use in the present invention that was added to each sample has been shown in terms of the molar ratio to silver.

The samples were exposed and the time-dependent stability of the photographic property of the exposed samples with the lapse of time was evaluated by the test method mentioned below.

Precisely, the samples were sensitometrically exposed and stored under a forced condition of 50° C. and 30% RH for 3 days. The thus-stored samples were then color-developed at 38° C. in accordance with the process mentioned below. The density of each of the processed samples was measured, using a red filter. The difference in the sensitivity between the sample that had been exposed, stored and then developed and the sample that had been exposed and then immediately developed was obtained, from which the stability of the sample was obtained.

The samples were exposed to light, and then processed in the following manner.

(Processing Step)

| Step | Processing Time | Processing Temp. (°C.) |
|---|---|---|
| Color development | 3 min 15 sec | 38 |
| Bleaching | 3 min 00 sec | 38 |
| Washing | 30 sec | 24 |
| Fixing | 3 min 00 sec | 38 |
| Washing (1) | 30 sec | 24 |
| Washing (2) | 30 sec | 24 |
| Stabilization | 30 sec | 38 |
| Drying | 4 min 20 sec | 55 |

The processing solutions had the following compositions:

| | Amount (g) |
|---|---|
| Color developing solution | |
| Diethylenetriaminepentaacetic Acid | 1.0 |
| 1-Hydroxyethylidene-1,1-diphosphonic Acid | 2.0 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-Ethyl-N-(β-hydroxyethyl)amino]-2-methylaniline Sulfate | 4.5 |
| Water to make | 1.0 liter |
| pH (adjusted with potassium hydroxide and sulfuric acid) | 10.05 |
| Bleaching Solution | |
| Sodium Ethylenediaminetetraacetato Ferrate Trihydrate | 100.0 |
| Disodium Ethylenediaminetetraacetate | 10.0 |
| 3-Mercapto-1,2,4-triazole | 0.03 |
| Ammonium Bromide | 140.0 |
| Ammonium Nitrate | 30.0 |
| Ammonia Water (27%) | 6.5 ml |
| Water to make | 1.0 liter |
| pH (adjusted with ammonia water and nitric acid) | 6.0 |
| Fixing Solution | |
| Disodium Ethylenediaminetetraacetate | 0.5 |
| Ammonium Sulfite | 20.0 |
| Aqueous Solution of Ammonium Thiosulfate (700 g/l) | 295.0 ml |
| Acetic Acid (90%) | 3.3 |
| Water to make | 1.0 liter |
| pH (adjusted with ammonia water and acetic acid) | 6.7 |
| Stabilizing Solution | |
| p-Nonylphenoxy[poly(glycidol)] (average degree of polymerization: 10) | 0.2 |
| Ethylenediaminetetraacetic acid | 0.05 |
| 1,2,4-Triazole | 1.3 |
| 1,4-Bis(1,2,4-triazole-1-ylmethyl)piperazine | 0.75 |
| Hydroxyacetic acid | 0.02 |
| Hydroxyethyl Cellulose (HEC SP-2000 of Daicel Chemical Industries, Ltd.) | 0.1 |
| 1,2-Benzisothiazolin-3-one | 0.05 |
| Water to make | 1.0 liter |
| pH | 8.5 |

The exposure of the samples was carried out by ordinary wedgewise exposure for 1/40 second, using a light source having a color temperature of 3200° K. through a filter.

The sensitivity of the sample was represented by the logarithmic value of the reciprocal of the amount of exposure that gave the optical density higher than the fog by 0.2.

In order to evaluate the variation of the photographic property of each of the exposed samples with the lapse of time, the sensitivity of the sample that had been exposed, stored under the forced condition and then developed was represented as a relative sensitivity to the sensitivity of the sample that had been exposed and then immediately developed, the relative sensitivity therefore being the difference between the logarithmic values obtained as above. The nearer to 0 (zero) the value of the relative sensitivity, the smaller the variation in the photographic property of the exposed and stored sample or, that is, the better the sample.

The test results obtained are shown in Table 1 below.

TABLE 1

| Sample | Emulsion | Mean Grain Size (μm) | Fluctuation Coefficient | Amount of Compound represented by Formula (A), per Ag, in Emulsion Layer (molar ratio) | Variation in Photographic Property of Exposed and Stored Sample with Lapse of Time (as sensitivity) |
|---|---|---|---|---|---|
| 101 (comparative sample) | Em-1 | 0.40 | 0.12 | — | −0.17 |
| 102 (comparative sample) | Em-2 | 0.31 | 0.12 | — | −0.19 |
| 103 (comparative sample) | Em-3 | 0.25 | 0.12 | — | −0.24 |
| 104 (comparative sample) | Em-4 | 0.18 | 0.12 | — | −0.33 |
| 105 (comparative sample) | Em-5 | 0.11 | 0.12 | — | −0.38 |
| 106 (comparative sample) | Em-1 | 0.40 | 0.12 | A-7 ($1.5 \times 10^{-2}$) | −0.12 |
| 107 (comparative sample) | Em-2 | 0.31 | 0.12 | A-7 ($1.5 \times 10^{-2}$) | −0.13 |
| 108 (sample of the invention) | Em-3 | 0.25 | 0.12 | A-7 ($1.5 \times 10^{-2}$) | −0.04 |
| 109 (sample of the invention) | Em-4 | 0.18 | 0.12 | A-7 ($1.5 \times 10^{-2}$) | −0.05 |
| 110 (sample of the invention) | Em-5 | 0.11 | 0.12 | A-7 ($1.5 \times 10^{-2}$) | −0.05 |
| 111 (comparative sample) | Em-1 | 0.40 | 0.12 | A-8 ($1.5 \times 10^{-2}$) | −0.13 |
| 112 (comparative sample) | Em-2 | 0.31 | 0.12 | A-8 ($1.5 \times 10^{-2}$) | −0.14 |
| 113 (sample of the invention) | Em-3 | 0.25 | 0.12 | A-8 ($1.5 \times 10^{-2}$) | −0.06 |
| 114 (sample of | Em-4 | 0.18 | 0.12 | A-8 ($1.5 \times 10^{-2}$) | −0.06 |

TABLE 1-continued

| Sample | Emulsion | Mean Grain Size (μm) | Fluctuation Coefficient | Amount of Compound represented by Formula (A), per Ag, in Emulsion Layer (molar ratio) | Variation in Photographic Property of Exposed and Stored Sample with Lapse of Time (as sensitivity) |
|---|---|---|---|---|---|
| the invention) | | | | | |
| 115 (sample of the invention) | Em-5 | 0.11 | 0.12 | A-8 ($1.5 \times 10^{-2}$) | −0.07 |

From the results in Table 1 above, it is obvious that the sensitivity of Sample Nos. 103 to 105 containing the emulsion having a mean grain size of 0.25 μm or smaller but not containing the compound represented by formula (A) for use in the present invention noticeably lowered while they were stored after exposure, but the degree of the lowering of the sensitivity of Sample Nos. to 110 and 113 to 115 containing the emulsion having a mean grain size of 0.25 μm or smaller along with the compound represented by formula (A) for use in the present invention was much reduced.

EXAMPLE 2

In the same manner as in Example 1, Emulsions (Em-A-1) to (Em-A-5) shown in Table 2 below were prepared.

TABLE 2

| Emulsion | Mean Grain Size (μm) | Fluctuation Coefficient | Mean Iodide Content (mol %) |
|---|---|---|---|
| Em-A-1 | 0.56 | 0.12 | 2.9 |
| Em-A-2 | 0.39 | 0.12 | 2.9 |
| Em-A-3 | 0.29 | 0.12 | 2.9 |
| Em-A-4 | 0.20 | 0.12 | 2.9 |
| Em-A-5 | 0.12 | 0.12 | 2.9 |

Using Emulsions (Em-A-1) to (Em-A-5), prepared were multi-layer color photographic material samples each having the layers mentioned below on a triacetyl cellulose support. The graininess, the sharpness and the stability of the photographic property with the lapse of time after exposure of these samples were evaluated.

In the layers mentioned below, the amounts of the silver halide and the colloidal silver coated have been represented by the amount of silver ($g/m^2$) therein; the amounts of the coupler, the additive and the gelatin coated have been represented by $g/m^2$; and the amount of the sensitizing dye coated has been represented by the number of mols per mol of the silver halide in the layer containing it.

| | |
|---|---|
| First Layer: Anti-halation Layer | |
| Black Colloidal Silver | 0.20 as Ag |
| Gelatin | 2.30 |
| Second Layer: Interlayer | |
| Cpd-1 | 0.10 |
| Gelatin | 0.80 |
| Third Layer: First Red-sensitive Emulsion Layer | |
| Emulsion A | 0.17 as Ag |
| ExS-4 | $1.2 \times 10^{-3}$ |
| ExC-1 | 0.29 |
| ExC-2 | 0.10 |
| ExC-3 | 0.05 |
| ExC-4 | 0.09 |
| Solv-1 | 0.10 |
| Solv-2 | 0.10 |

-continued

| | |
|---|---|
| Gelatin | 2.40 |
| Fourth Layer: Second Red-sensitive Emulsion Layer | |
| Emulsion B | 0.12 as Ag |
| ExS-4 | $5.1 \times 10^{-4}$ |
| ExC-1 | 0.12 |
| ExC-2 | 0.04 |
| ExC-4 | 0.03 |
| Solv-1 | 0.05 |
| Solv-2 | 0.05 |
| Gelatin | 0.85 |
| Fifth Layer: Third Red-sensitive Emulsion Layer | |
| Emulsion C | 0.35 as Ag |
| ExS-4 | $2.1 \times 10^{-4}$ |
| ExC-1 | 0.085 |
| ExC-2 | 0.055 |
| ExC-4 | 0.030 |
| Solv-1 | 0.03 |
| Solv-2 | 0.03 |
| Gelatin | 1.10 |
| Sixth Layer: Interlayer | |
| Cpd-1 | 0.13 |
| Gelatin | 0.65 |
| Seventh Layer: First Green-sensitive Emulsion Layer | |
| Emulsion D | 0.40 as Ag |
| ExS-2 | $1.26 \times 10^{-3}$ |
| ExS-3 | $1.40 \times 10^{-4}$ |
| ExM-1 | 0.25 |
| ExM-2 | 0.05 |
| ExM-3 | 0.05 |
| ExM-6 | 0.05 |
| Solv-1 | 0.42 |
| Gelatin | 2.60 |
| Eighth Layer: Second Green-sensitive Emulsion Layer | |
| Emulsion E | 0.14 as Ag |
| ExS-2 | $8.0 \times 10^{-4}$ |
| ExS-3 | $9.0 \times 10^{-5}$ |
| ExM-1 | 0.07 |
| ExM-2 | 0.02 |
| ExM-3 | 0.015 |
| ExM-4 | 0.006 |
| ExM-5 | 0.002 |
| ExM-6 | 0.01 |
| Solv-1 | 0.15 |
| Gelatin | 0.60 |
| Ninth Layer: Third Green-sensitive Emulsion Layer | |
| Emulsion F | 0.45 as Ag |
| ExS-2 | $7.8 \times 10^{-4}$ |
| ExS-3 | $8.8 \times 10^{-5}$ |
| ExM-1 | 0.08 |
| ExM-2 | 0.02 |
| ExM-3 | 0.02 |
| ExM-4 | 0.008 |
| ExM-5 | 0.002 |
| ExM-6 | 0.01 |
| Solv-1 | 0.14 |

-continued

| | |
|---|---|
| Gelatin | 0.90 |
| Tenth Layer: Yellow Filter Layer | |
| Yellow Colloidal Silver | 0.15 as Ag |
| Cpd-1 | 0.10 |
| Cpd-2 | 0.05 |
| Gelatin | 1.0 |
| Eleventh Layer: First Blue-sensitive Emulsion Layer | |
| Emulsion G | 0.23 as Ag |
| ExS-1 | $2.5 \times 10^{-3}$ |
| ExC-1 | 0.03 |
| ExY-1 | 0.60 |
| ExY-2 | 0.10 |
| Solv-1 | 0.25 |
| Gelatin | 1.10 |
| Twelfth Layer: Second Blue-sensitive Emulsion Layer | |
| Emulsion H | 0.20 as Ag |
| ExS-1 | $2.0 \times 10^{-3}$ |
| ExC-1 | 0.01 |
| ExY-1 | 0.18 |
| ExY-2 | 0.08 |
| Solv-1 | 0.09 |
| Gelatin | 0.45 |
| Thirteenth Layer: Third Blue-sensitive Emulsion Layer | |
| Emulsion I | 0.39 as Ag |

-continued

| | |
|---|---|
| ExC-1 | 0.003 |
| ExY-1 | 0.05 |
| ExY-2 | 0.02 |
| Solv-1 | 0.02 |
| Gelatin | 0.60 |
| Fourteenth Layer: First Protective Layer | |
| UV-1 | 0.05 |
| UV-2 | 0.24 |
| Solv-2 | 0.12 |
| Gelatin | 0.50 |
| Fifteenth Layer: Second Protective Layer | |
| B-1 (diameter, 1.70 μm) | 0.01 |
| B-2 (diameter, 1.70 μm) | 0.01 |
| B-3 | 0.09 |
| H-1 | 0.30 |

The sample contained 1,2-benzisothiazolin-3-one (200 ppm on average, relative to gelatin), n-butyl p-hydroxybenzoate (about 1000 ppm, relative to the same) and 2-phenoxyethanol (about 10000 ppm, relative to the same), in addition to the above-mentioned components.

The sample further contained B-4, B-5, W-1, W-2, F-1 to F-12.

The structural formulae of the compounds used in preparing the sample are shown below.

ExC-1

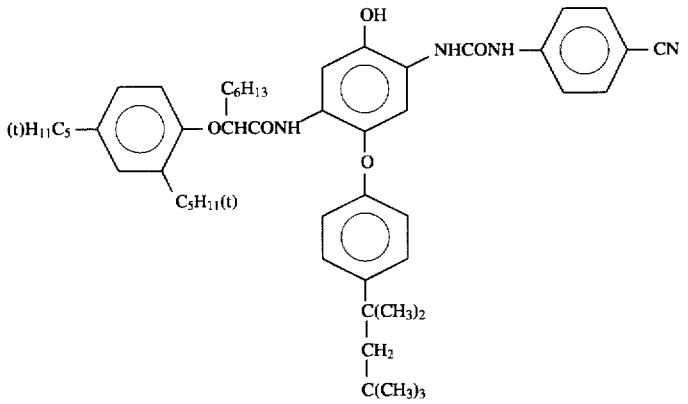

ExC-2

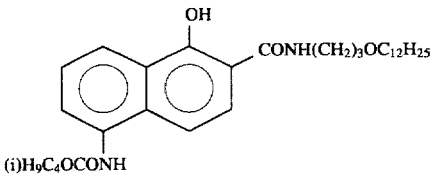

ExC-3

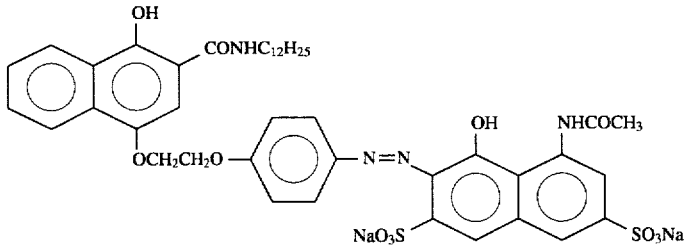

-continued
ExC-4
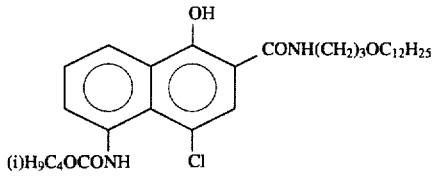
ExM-1
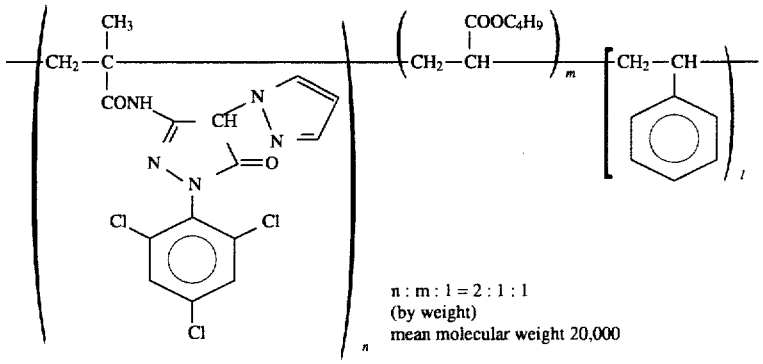
ExM-2
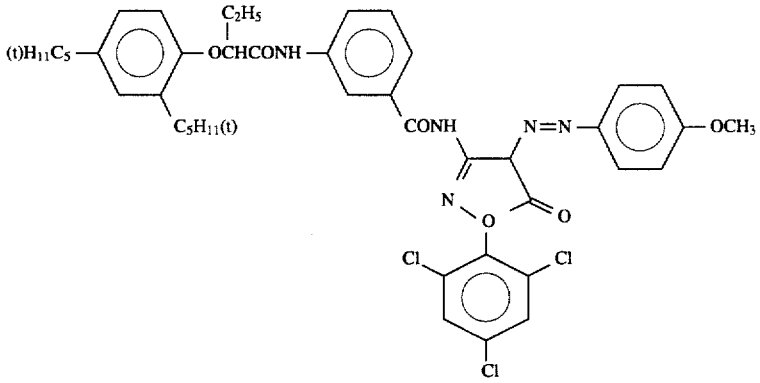
ExM-3
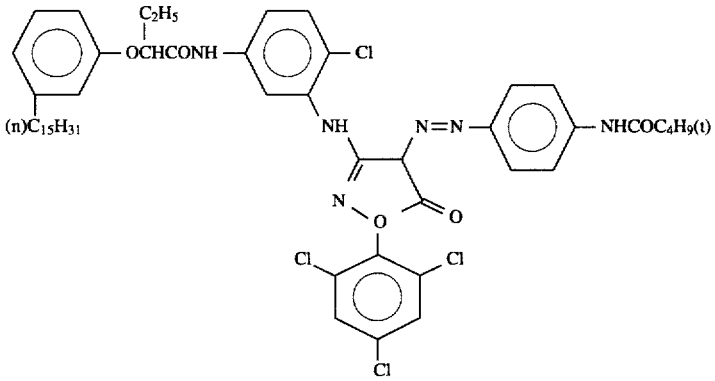
ExM-4
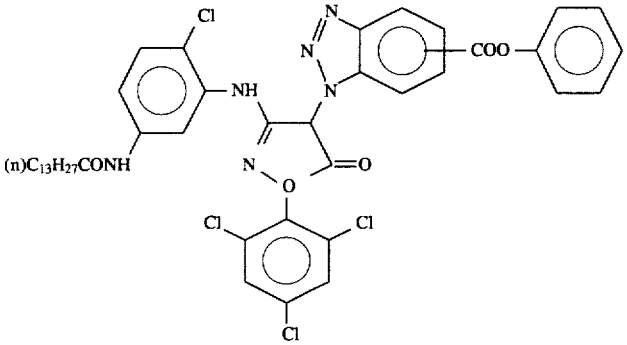

-continued
ExM-5
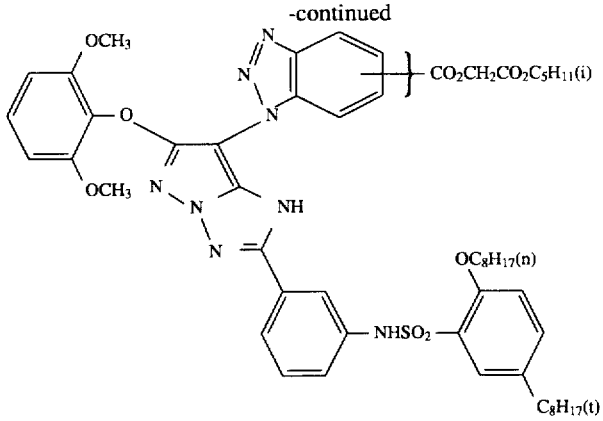
ExM-6
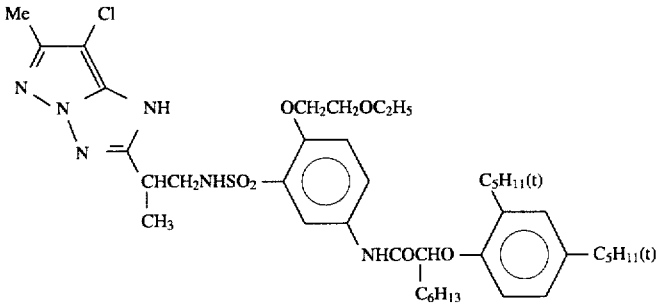
ExY-1
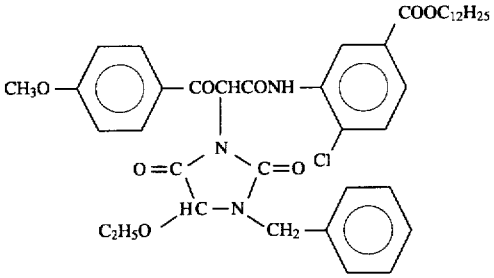
ExY-2
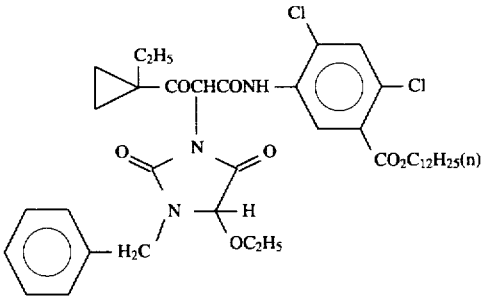
ExS-1
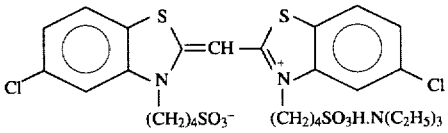
ExS-2
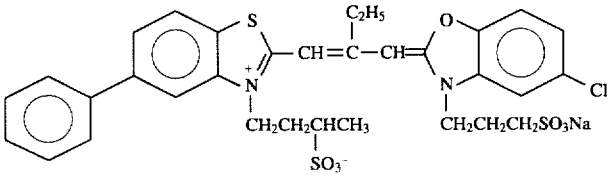
ExS-3
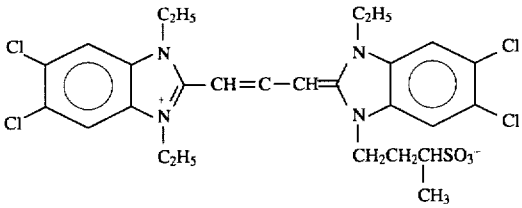
ExS-4
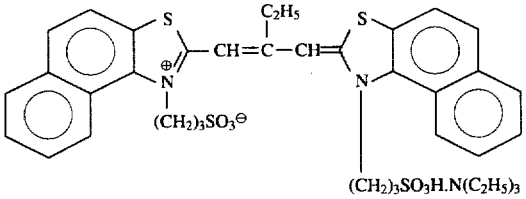
Solv-1
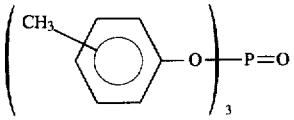
Solv-2
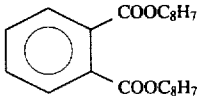

-continued
Cpd-1
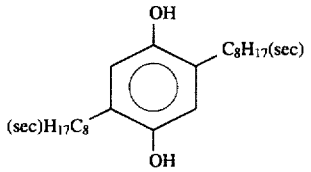
Cpd-2
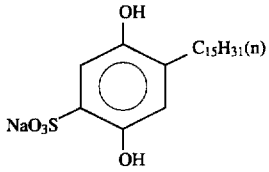
UV-1
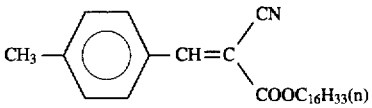
UV-2
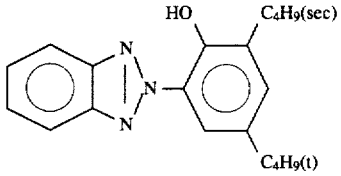
B-1
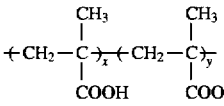
x/y = 10/90 (by weight)
mean molecular weight:
ca. 35,000
B-2
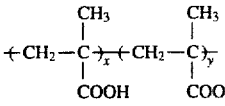
x/y = 40/60 (by weight)
mean molecular weight:
ca. 20,000
B-3
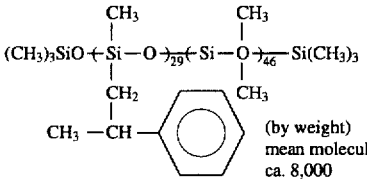
(by weight)
mean molecular weight:
ca. 8,000
B-4
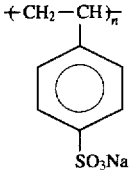
mean molecular weight:
ca. 750,000
B-5
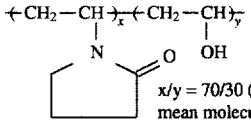
x/y = 70/30 (by weight)
mean molecular weight:
ca. 17,000
W-1
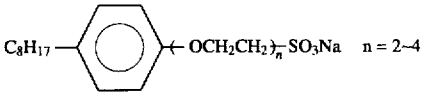
n = 2–4
W-2
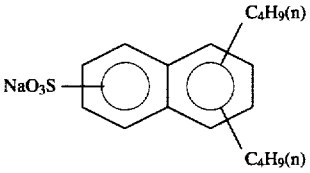
H-1
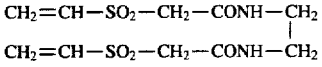
F-1
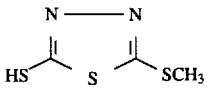
F-2
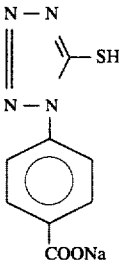
F-3
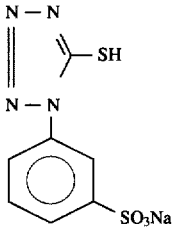
F-4
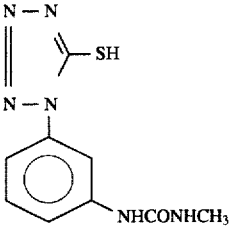
F-5
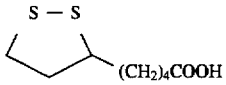
F-6
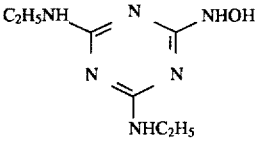

-continued

F-7

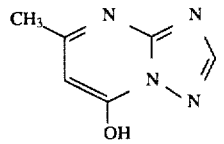

F-8

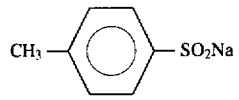

F-9

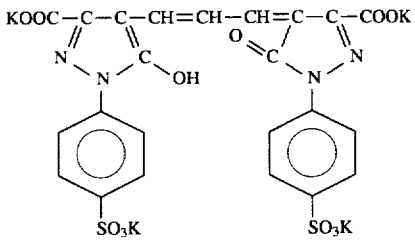

F-10

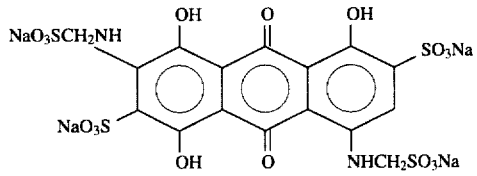

F-11

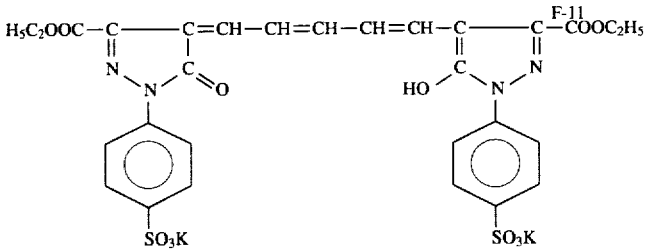

F-12

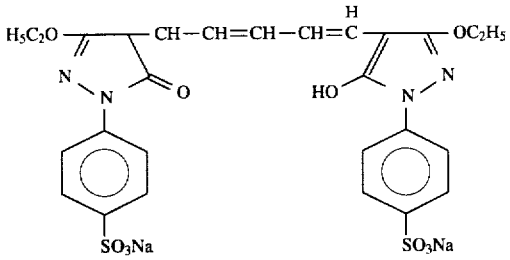

Emulsions A to I were chosen from among the above-mentioned Emulsions (Em-A-1) to (Em-A-5) in the manner as indicated in Table 3 below. The compound(s) represented by formula (A) for use in the present invention was/were added to the red-sensitive emulsion layer(s) in the manner as indicated in Table 3. Thus, Sample Nos. 201 to 210 shown in Table 3 were prepared.

TABLE 3

| | Emulsion | | | | | | | | | Amount by mol of Compound represented by Formula (A) for use in the Invention, per mol of Ag, in Emulsion Layers | | |
|---|---|---|---|---|---|---|---|---|---|---|---|---|
| Sample | A | B | C | D | E | F | G | H | I | 1st Red-sensitive Emulsion Layer | 2nd Red-sensitive Emulsion Layer | 3rd Red-sensitive Emulsion Layer |
| 201 (comparative sample) | Em-A-3 | Em-A-2 | Em-A-1 | Em-A-3 | Em-A-2 | Em-A-1 | Em-A-3 | Em-A-2 | Em-A-1 | — | — | — |
| 202 (comparative sample) | Em-A-5 | Em-A-4 | Em-A-3 | Em-A-5 | Em-A-4 | Em-A-3 | Em-A-5 | Em-A-4 | Em-A-3 | — | — | — |
| 203 (comparative sample) | Em-A-3 | Em-A-2 | Em-A-1 | Em-A-3 | Em-A-2 | Em-A-1 | Em-A-3 | Em-A-2 | Em-A-1 | — | — | A-7 ($4.5 \times 10^{-2}$) |
| 204 (comparative sample) | Em-A-3 | Em-A-2 | Em-A-1 | Em-A-3 | Em-A-2 | Em-A-1 | Em-A-3 | Em-A-2 | Em-A-1 | A-7 ($1.5 \times 10^{-2}$) | A-7 ($1.5 \times 10^{-2}$) | A-7 ($1.5 \times 10^{-2}$) |
| 205 (sample of the invention) | Em-A-5 | Em-A-4 | Em-A-3 | Em-A-5 | Em-A-4 | Em-A-3 | Em-A-5 | Em-A-4 | Em-A-3 | — | — | A-7 ($4.5 \times 10^{-2}$) |

TABLE 3-continued

| Sample | Emulsion A | B | C | D | E | F | G | H | I | Amount by mol of Compound represented by Formula (A) for use in the Invention, per mol of Ag, in Emulsion Layers: 1st Red-sensitive Emulsion Layer | 2nd Red-sensitive Emulsion Layer | 3rd Red-sensitive Emulsion Layer |
|---|---|---|---|---|---|---|---|---|---|---|---|---|
| 206 (sample of the invention) | Em-A-5 | Em-A-4 | Em-A-3 | Em-A-5 | Em-A-4 | Em-A-3 | Em-A-5 | Em-A-4 | Em-A-3 | A-7 ($1.5 \times 10^{-2}$) | A-7 ($1.5 \times 10^{-2}$) | A-7 ($1.5 \times 10^{-2}$) |
| 207 (comparative sample) | Em-A-3 | Em-A-2 | Em-A-1 | Em-A-3 | Em-A-2 | Em-A-1 | Em-A-3 | Em-A-2 | Em-A-1 | — | — | A-10 ($4.5 \times 10^{-2}$) |
| 208 (comparative sample) | Em-A-3 | Em-A-2 | Em-A-1 | Em-A-3 | Em-A-2 | Em-A-1 | Em-A-3 | Em-A-2 | Em-A-1 | A-10 ($1.5 \times 10^{-2}$) | A-10 ($1.5 \times 10^{-2}$) | A-10 ($1.5 \times 10^{-2}$) |
| 209 (sample of the invention) | Em-A-5 | Em-A-4 | Em-A-3 | Em-A-5 | Em-A-4 | Em-A-3 | Em-A-5 | Em-A-4 | Em-A-3 | — | — | A-10 ($4.5 \times 10^{-2}$) |
| 210 (sample of the invention) | Em-A-5 | Em-A-4 | Em-A-3 | Em-A-5 | Em-A-4 | Em-A-3 | Em-A-5 | Em-A-4 | Em-A-3 | A-10 ($1.5 \times 10^{-2}$) | A-10 ($1.5 \times 10^{-2}$) | A-10 ($1.5 \times 10^{-2}$) |

These samples were sensitometrically exposed and then color-developed in the same manner as in Example 1. The sensitivity of the processed samples was measured, using a red filter, a green filter and a blue filter.

The stability of the photographic property of the exposed samples with the lapse of time was evaluated in the same manner as in Example 1. In this example, the density measured through the red filter was used for obtaining the relative sensitivity. The stability with the lapse of time was evaluated by the thus obtained relative sensitivity which is the difference in the sensitivity between the sample that was exposed, stored under the forced condition and then developed and the sample that was exposed and then immediately developed.

In this example, the sensitivity was represented by the logarithmic number of the reciprocal of the amount of exposure that gave the optical density higher than the fog by 1.5.

Secondly, in order to evaluate the graininess of the red-sensitive layer, the green-sensitive layer and the blue-sensitive layer of each sample, the RMS granularity of each sample was measured through a red filter, a green filter and a blue filter, using an aperture of 48 μmϕ. The RMS granularity has been defined to be equal to the value which is 1000 times the value RMS measured at the density of (Dmin+1.0), where Dmin means the minimum image density. The smaller the value, the better the graininess.

Thirdly, in order to evaluate the sharpness of the samples, each sample was exposed to a white light through a filter having a black-and-white sharp contrast image and a repeating linear stripe pattern having the same density step as that of the image, at a frequency of 40 cycles/mm, and then processed in the same manner as above. Using a microdensitometer, the density of the processed sample was measured through a G filter and an R filter. From the data obtained, the squarewave response function (SRF) that is defined by the following equation was obtained.

SRF=(Dmax−Dmin)÷ΔD where Dmax is the maximum value of the micro density of the stripe pattern image;

Dmin is the minimum value of the micro density of the stripe pattern image; and

ΔD is the difference between the maximum density of the sharp contrast image and the minimum density thereof.

The larger the SRF value, the better the sharpness.

The test results obtained are shown in Table 4 below. RMS granularity and SRF value have been represented by the relative values, based on the value (100) of Sample No. 201.

From the results in Table 4, it is obvious that the photographic material samples of the present invention have excellent graininess and sharpness and that, when they were exposed and then stored, the lowering of their sensitivity after storage was small.

In particular, it is noted therefrom that Sample Nos. 206 and 210 which contained the compound represented by formula (A) for use in the present invention and the emulsion having a mean grain size of 0.25 μm or smaller for use in the present invention in the same layers were better than the others, as the lowering of their sensitivity after storage was extremely small.

Regarding the graininess, the same results were obtained when an aperture of 10 μmϕ was used.

TABLE 4

| Sample | Variation in Photographic Property of Exposed and Stored Sample with Lapse of Time (as variation in sensitivity) | RMS Graininess (as relative value) Red-sensitive Layer | Green-sensitive Layer | Blue-sensitive Layer | SRF (as relative value) Red-sensitive Layer | Green-sensitive Layer |
|---|---|---|---|---|---|---|
| 201 (comparative sample) | −0.15 | 100 | 100 | 100 | 100 | 100 |
| 202 (comparative sample) | −0.24 | 30 | 31 | 28 | 306 | 181 |
| 203 (comparative sample) | −0.10 | 99 | 101 | 101 | 100 | 98 |
| 204 (comparative sample) | −0.09 | 98 | 100 | 101 | 101 | 97 |
| 205 (sample of the invention) | −0.08 | 29 | 30 | 28 | 314 | 183 |
| 206 (sample of the invention) | −0.04 | 29 | 30 | 27 | 315 | 185 |
| 207 (comparative sample) | −0.12 | 98 | 101 | 101 | 100 | 101 |
| 208 (comparative sample) | −0.11 | 100 | 103 | 102 | 103 | 100 |
| 209 (sample of the invention) | −0.08 | 30 | 31 | 29 | 313 | 180 |
| 210 (sample of the invention) | −0.05 | 28 | 29 | 27 | 312 | 182 |

EXAMPLE 3

Multi-layer color photographic material samples (Sample Nos. 201 to 210) of Example 2 were exposed in the same manner as in Example 2 and then processed in accordance with the process mentioned below. The stability of the photographic property after exposure with the lapse of time, the graininess and the sharpness of the processed samples were evaluated in the same manner as in Example 2. The same results as those in Example 2 were obtained.

| Step | Temperature (°C.) | Time |
|---|---|---|
| (1) Pre-bath | 27 ± 1 | 10 sec |
| (2) Removal of Backing and Spray-Washing | 27 to 38 | 5 sec |
| (3) Color Development | 41.1 ± 0.1 | 3 min |
| (4) Stopping | 27 to 38 | 30 sec |
| (5) Bleaching Acceleration | 27 ± 1 | 30 sec |
| (6) Bleaching | 38 ± 1 | 3 min |
| (7) Washing | 27 to 38 | 1 min |
| (8) Fixation | 38 ± 1 | 2 min |
| (9) Washing | 27 to 38 | 2 min |
| (10) Stabilization | 27 to 38 | 10 sec |

Compositions of the processing solutions used in the processing steps are mentioned below.

| | |
|---|---|
| (1) Pre-bath: | |
| Water of 27 to 38° C. | 800 ml |
| Borax (10-hydrate) | 20.0 g |
| Sodium Sulfate (anhydride) | 100 g |
| Sodium Hydroxide | 1.0 g |
| Water to make | 1.00 liter |
| pH (27° C.) | 9.25 |
| (3) Color Developer: | |
| Water of 21 to 38° C. | 850 ml |
| Kodak Anti-calcium No. 4 | 2.0 ml |

-continued

| | |
|---|---|
| Sodium Sulfite (anhydride) | 2.0 g |
| Eastman Anti-fog No. 9 | 0.22 g |
| Sodium Bromide (anhydride) | 1.20 g |
| Sodium Carbonate (anhydride) | 25.6 g |
| Sodium Bicarbonate | 2.7 g |
| Color Developing Agent, 4-amino-3-methyl-N-ethyl-N-(β-methanesulfonamidoethyl)aniline | 4.0 g |
| Water to make | 1.00 liter |
| pH (27° C.) | 10.20 |
| (4) Stopping Bath: | |
| Water of 21 to 38° C. | 900 ml |
| 7.0 N Sulfuric Acid | 50 ml |
| Water to make | 1.00 liter |
| pH (27° C.) | 0.9 |
| (5) Bleaching Accelerator | |
| Water | 900 ml |
| Sodium Metabisulfite (anhydride) | 10.0 g |
| Glacial Acetic Acid | 25.0 ml |
| Sodium Acetate | 10.0 g |
| EDTA-4Na | 0.7 g |
| PBA (2-dimethylaminoethylisothiourea dihydrochloride) | 5.5 g |
| Water to make | 1.0 liter |
| pH (27° C.) | 3.8 ± 0.2 |
| (6) Bleaching Solution: | |
| Water of 24 to 38° C. | 800 ml |
| Gelatin | 0.5 g |
| Sodium Persulfate | 33.0 g |
| Sodium Chloride | 15.0 g |
| Sodium Primary Phosphate (anhydride) | 9.0 g |
| Phosphoric Acid (85%) | 2.5 ml |
| Water to make | 1.0 liter |
| pH (27° C.) | 2.3 ± 0.2 |
| (8) Fixing Solution: | |
| Water of 20 to 38° C. | 700 ml |
| Kodak Anti-calcium No. 4 | 2.0 ml |
| 58% Ammonium Thiosulfate Solution | 185 ml |
| Sodium Sulfite (anhydride) | 10.0 g |
| Sodium Bisulfite (anhydride) | 8.4 g |

-continued

| | |
|---|---|
| Water to make | 1.0 liter |
| pH (27° C.) | 6.5 |
| (10) Stabilizer: | |
| Water of 21 to 27° C. | 1.00 liter |
| Kodak Stabilizer Additive | 0.14 ml |
| Formalin (37.5% solution) | 1.50 ml |

EXAMPLE 4

Emulsion (NY-1) containing Coupler (CP-2) used in Example 1 and Compound (A-7) for use in the invention was prepared in the manner as mentioned below. Precisely, the following oily phase and aqueous phase were prepared separately under heat, mixed together, and emulsified and dispersed for 10 minutes using a household mixer.

| Oily Phase: | |
|---|---|
| Coupler (CP-2) | 80 g |
| Compound (A-7) represented by Formula (A) for use in the Present Invention | 5 g |
| Surfactant (W-3) | 6 g |
| Ethyl Acetate | 130 g |
| **Aqueous Phase:** | |
| Gelatin ($Ca^{2+}$ content, 1000 ppm; mean molecular weight: 500,000) | 150 g |
| Water to make | 1400 g |

In the same manner as in preparation of Emulsion (NY-1), Emulsions (NY-1) to (NY-3) shown in Table 5 were prepared.

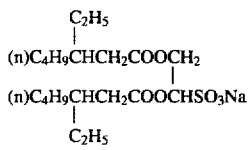

(W-3)

Emulsion (NY-1) was mixed with Emulsion (Em-5) of Example 1. Using the mixture, the following layers were coated on the support in the same manner as in Example 1 to prepare a coated sample (Sample No. 401).

| First Layer: Emulsion Layer | |
|---|---|
| Emulsion (Em-5) | 0.8 g/m² as Ag |
| Coupler CP-2 | 0.8 g/m² |
| Compound (A-7) | 0.05 g/m² |
| Gelatin | 3.5 g/m² |
| **Second Layer: Protective Layer** | |
| Gelatin | 1.5 g/m² |
| Polymethyl Methacrylate Grains (diameter 2.0 μm) | 0.05 g/m² |
| 2,4-Dichloro-6-hydroxy-S-triazine Sodium Salt | 0.09 g/m² |

In the same manner as in preparation of Sample No. 401 as above, Sample Nos. 402 and 403 shown in Table 5 below were prepared.

These were exposed and the stability of the photographic property of the exposed samples with the lapse of time was evaluated in the same manner as in Example 1.

In addition, the cold stability of the emulsions with the lapse of time was evaluated in the manner mentioned below. Precisely, Emulsions (NY-1) to (NY-3) were stored in a refrigerator that had been conditioned to have a settled temperature of 8° C., for 30 days. Using the emulsions thus stored in the cold space, Sample Nos. 401R to 403R were prepared in the same manner as in preparation of Sample Nos. 401 to 403, respectively.

Sample Nos. 401 to 403 and Sample Nos. 401R to 403R were sensitometrically exposed and then color-developed in the same manner as in Example 1, and the density of the developed samples was measured through a red filter.

The maximum density (Dmax) of Sample Nos. 401 to 403 that had been prepared using the fresh emulsions was compared with that of Sample Nos. 401R to 403R, respectively, that had been prepared using the cold-stored emulsions, from which the lowering of Dmax was obtained as the relative value. The values thus obtained indicate the cold stability of the emulsions with the lapse of time.

Further, Sample No. 404 was prepared in the same manner as in preparation of Sample No. 403, except for adding Compound (A-7) for use in the present invention in the form of a methanol solution at the coating step. Sample No. 404 thus obtained was evaluated in the same manner as above.

The results obtained are shown in Table 5.

TABLE 5

| Sample | Emulsion | Compound represented by Formula (A) in Emulsion (molar ratio to coupler in emulsion) | Variation in Photographic Property of Exposed Sample with Lapse of Time (as variation in sensitivity) | Cold Stability of Emulsion with Lapse of Time |
|---|---|---|---|---|
| 401 (sample of the invention) | NY-1 | A-7 (0.1) | −0.06 | 98 |
| 402 (sample of the invention) | NY-2 | A-10 (0.1) | −0.07 | 97 |
| 403 (comparative sample) | NY-3 | — | −0.40 | 69 |
| 404 (sample of the invention) | NY-3 | A-7 (0.1) | −0.10 | 67 |

From the results in Table 5, it is obvious that the lowering of the sensitivity of the photographic material samples of the present invention, containing the fine emulsion along with the compound represented by formula (A) for use in the present invention was extremely small, while stored after exposure.

In addition, Emulsions (NY-1) and (NY-2) that were prepared by co-emulsifying the compound represented by formula (A) according to the present invention along with the coupler are further preferred as having improved cold stability with the lapse of time.

The silver halide color photographic material of the present invention has excellent graininess and sharpness. In addition, the photographic material has been improved in that the photographic properties of the exposed photographic material are worsened little while stored after exposure.

EXAMPLE 5

In the same manner as in Example 1, three emulsions having a mean grain size of 0.12 μm, 0.08 μm and 0.05 μm, respectively, were prepared. Using these emulsions, prepared were coated samples in the same manner as in Example 1. The variation with the lapse of time of photographic property (as sensitivity) of each sample was evaluated in the same manner as in Example 1.

The results thus obtained are shown in Table 6.

TABLE 6

| Sample | Mean Grain Size (μm) | Fluctuation Coefficient | Amount of Compound represented by Formula (A), per Ag, in Emulsion Layers (molar ratio) | Variation in Photographic Property of Exposed and Stored Sample with Lapse of Time (as sensitivity) |
|---|---|---|---|---|
| 501 | 0.12 | 0.12 | A-7 ($3.0 \times 10^{-2}$) | −0.02 |
| 502 | 0.08 | 0.12 | A-7 ($3.0 \times 10^{-2}$) | −0.06 |
| 503 | 0.05 | 0.12 | A-7 ($3.0 \times 10^{-2}$) | −0.07 |
| 504 | 0.12 | 0.12 | A-12 ($3.0 \times 10^{-2}$) | −0.03 |
| 505 | 0.08 | 0.12 | A-12 ($3.0 \times 10^{-2}$) | −0.07 |
| 506 | 0.05 | 0.12 | A-12 ($3.0 \times 10^{-2}$) | −0.07 |
| 507 | 0.12 | 0.12 | A-37 ($3.0 \times 10^{-2}$) | −0.03 |
| 508 | 0.08 | 0.12 | A-37 ($3.0 \times 10^{-2}$) | −0.06 |
| 509 | 0.05 | 0.12 | A-37 ($3.0 \times 10^{-2}$) | −0.06 |

Sample Nos. 501 to 509 shown in Table 6 above each is the photographic material of the present invention. The degree of the lowering of the sensitivity of Sample Nos. 501, 504 and 507 containing an emulsion having a mean grain size fallen within the scope of larger than 0.10 μm and 0.25 μm or smaller was particularly reduced, even after the exposed samples were stored, which is preferred.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one blue-sensitive silver halide emulsion layer containing a yellow coupler, at least one green-sensitive silver halide emulsion layer containing a magenta coupler and at least one red-sensitive silver halide emulsion layer containing a cyan coupler, wherein the material comprises at least one layer which contains at least one compound selected from those represented by the following formula (A), wherein the silver halide grains in at least one of the silver halide emulsion layers have a mean grain size of 0.25 μm or smaller and wherein said at least one compound is in the same layer containing the silver halide emulsion having a mean grain size of 0.25 μm or smaller,

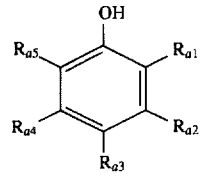

(A)

wherein $R_{a1}$ to $R_{a5}$, which are the same or different, each represents (1) a hydrogen atom, (2) an alkyl group, (3) —X—$R_{a0}$, or (4) a group necessary for forming a chroman ring by two of $R_{a1}$ to $R_{Ra5}$ which are ortho-positioned and are bonded to each other; X represents —C($R_{a6}$)($R_{a7}$)—, —O—, or —S—; $R_{a6}$ and $R_{a7}$ each represents a hydrogen atom or an alkyl group; $R_{a0}$ represents a hydroxyphenyl group, but it may be an alkyl group when X is —C($R_{a6}$)($R_{a7}$)—, both $R_{a6}$ and $R_{a7}$ are alkyl groups and both $R_{a1}$ and $R_{a5}$ are (—X—$R_{a0}$)'s; provided that $R_{a3}$ must not be a hydrogen atom, that at least one of $R_{a1}$ to $R_{a5}$ is the group (3) or (4) and that, when $R_{a3}$ is —X—$R_{a0}$ and $R_{a0}$ is a hydroxyphenyl group, both $R_{a1}$ and $R_{a5}$ must not be hydrogen atoms.

2. The silver halide color photographic material as claimed in claim 1, wherein said silver halide grains in at least one of the silver halide emulsion layer have a mean grain size of larger than 0.10 μm and smaller than 0.25 μm.

3. The silver halide color photographic material as claimed in claim 2, wherein said at least one compound is co-emulsified along with the yellow coupler, the magenta coupler or the cyan coupler.

4. The silver halide color photographic material as claimed in claim 1, wherein said at least one compound is selected from those represented by the following formula (A-1):

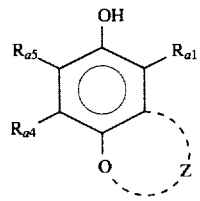

(A-I)

wherein $Ra_1$, $Ra_4$ and $R_{a5}$ have the same meanings as those defined in the formula (A); and Z represents an atomic group necessary for forming a chroman ring.

5. The silver halide color photographic material as claimed in claim 4, wherein $Ra_5$ is an alkyl group.

6. The silver halide color photographic material as claimed in claim 1, wherein said at least one compound is selected from those represented by the following formula (A-II):

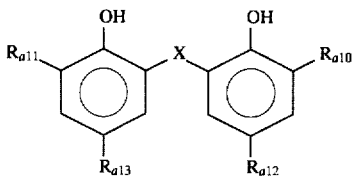

(A-II)

wherein X has the same meaning as that defined in the formula (A); and $Ra_{10}$ to $Ra_{13}$ each represents an alkyl group.

7. The silver halide color photographic material as claimed in claim 6, wherein X is —CH($Ra_6$)— in which $Ra_6$ has the same meaning as that defined in the formula (A).

8. The silver halide color photographic material as claimed in claim 7, wherein $Ra_6$ is a hydrogen atom or an alkyl group having from 1 to 11 carbon atoms.

9. The silver halide color photographic material as claimed in claim 1, wherein the amount of said at least one compound is from $1\times10^{-4}$ to 10 mol per mol of the silver halide in the layer to which the compound is added.

10. The silver halide color photographic material as claimed in claim 9, wherein the amount of said at least one compound is from $1\times10^{-3}$ to 1 mol per mol of the silver halide in the layer to which the compound is added.

11. The silver halide color photographic material as claimed in claim 10, wherein the amount of said at least one compound is from $5\times10^{-3}$ to $1\times10^{-1}$ mol per mol of the silver halide in the layer to which the compound is added.

* * * * *